US008847513B2

(12) United States Patent
Van De Ven et al.

(10) Patent No.: US 8,847,513 B2
(45) Date of Patent: Sep. 30, 2014

(54) METHOD AND APPARATUS FOR CONTROLLING LIGHT OUTPUT COLOR AND/OR BRIGHTNESS

(75) Inventors: Antony Paul Van De Ven, Hong Kong (CN); Gerald H. Negley, Durham, NC (US)

(73) Assignee: Cree, Inc., Durham, NC (US)

( * ) Notice: Subject to any disclaimer, the term of this patent is extended or adjusted under 35 U.S.C. 154(b) by 310 days.

(21) Appl. No.: 13/042,668

(22) Filed: Mar. 8, 2011

(65) Prior Publication Data

US 2012/0229032 A1 Sep. 13, 2012

(51) Int. Cl.
*H05B 37/02* (2006.01)
*H05B 33/08* (2006.01)

(52) U.S. Cl.
CPC ..... *H05B 33/086* (2013.01)
USPC ..... 315/307; 315/151; 315/312

(58) Field of Classification Search
USPC ..... 315/149–159, 291, 294, 297, 299, 315/307–308, 312
See application file for complete search history.

(56) References Cited

U.S. PATENT DOCUMENTS

| | | | | |
|---|---|---|---|---|
| 6,630,801 | B2 * | 10/2003 | Schuurmans | 315/307 |
| 7,012,382 | B2 * | 3/2006 | Cheang et al. | 315/291 |
| 7,315,139 | B1 * | 1/2008 | Selvan et al. | 315/291 |
| 7,319,298 | B2 * | 1/2008 | Jungwirth et al. | 315/307 |
| 7,759,854 | B2 * | 7/2010 | Miller et al. | 313/498 |
| 7,948,190 | B2 * | 5/2011 | Grajcar | 315/291 |
| 2003/0076056 | A1 * | 4/2003 | Schuurmans | 315/291 |
| 2005/0275912 | A1 * | 12/2005 | Chen et al. | 358/523 |
| 2007/0278974 | A1 | 12/2007 | Van de Ven | |
| 2008/0130285 | A1 | 6/2008 | Negley | |
| 2008/0309255 | A1 | 12/2008 | Myers | |
| 2009/0296384 | A1 | 12/2009 | Van de Ven | |
| 2010/0072901 | A1 * | 3/2010 | De Rijck et al. | 315/152 |
| 2010/0102199 | A1 | 4/2010 | Negley | |
| 2010/0103678 | A1 | 4/2010 | Van de Ven | |
| 2010/0148675 | A1 | 6/2010 | Johannes et al. | |
| 2010/0320928 | A1 * | 12/2010 | Kaihotsu et al. | 315/250 |
| 2011/0037409 | A1 | 2/2011 | Van de Ven | |

OTHER PUBLICATIONS

U.S. Appl. No. 61/245,688, filed Sep. 25, 2009, Pickard.

* cited by examiner

*Primary Examiner* — Tung X Le
(74) *Attorney, Agent, or Firm* — Burr & Brown, PLLC

(57) ABSTRACT

A lighting device, comprising first and second light emitters that emit light having first and second color points, respectively, and first and second sensors that detect brightness of light within 0.01 delta u', v' of the first and second color points, respectively. A method comprising supplying energy to first and second light, emitters that emit light having first and second color points, respectively, and detecting brightness of light within 0.01 delta u', v' of the first and second color points, respectively.

34 Claims, 5 Drawing Sheets

METHOD AND APPARATUS FOR CONTROLLING LIGHT OUTPUT COLOR AND/OR BRIGHTNESS

FIELD OF THE INVENTIVE SUBJECT MATTER

The present inventive subject matter relates to lighting devices and methods of lighting. In some aspects, the present inventive subject matter relates to lighting devices in which light of at least two different colors is mixed, and to methods of mixing light of at least two different colors. In some aspects, the present inventive subject matter relates to lighting devices in which the color and/or brightness of light output from the lighting devices is controlled, and to methods of controlling the color and/or brightness of light output from lighting devices.

BACKGROUND

Mixing light from light emitters that emit light of different colors (e.g., solid state light emitters, such as light emitting diodes and luminescent materials) may allow for the production of light of a desired hue, e.g., white light of a desired color temperature, and can in some cases provide good CRI Ra and/or high energy efficiency. For instance, in some cases, non-saturated bluish yellow light (e.g., from a light source that comprises a light emitting diode that emits saturated blue light and a luminescent material that emits non-saturated yellowish-green light) and red light (e.g., from a light source that comprises a light emitting diode that emits saturated red light) can be mixed to provide very high CRI Ra white light (CRI Ra of 90 or greater) at very high efficiencies. The term "hue" is used herein to refer to the color of light (e.g., light emitted by a light emitter or light that is a mixture of light emitted from two or more light emitters) corresponding to a particular color point on a Chromaticity Diagram (discussed below).

One difficulty with mixing light of different colors can occur if the respective light sources (that emit light of different colors) respond differently to variations in operating parameters. For example, if the respective light sources that emit light of different colors are from different materials systems, such as InGaN and AlInGaP, the output characteristics may respond differently to changes in operating temperature or current, or their output may change with time at different rates. Unless these changes are taken into account in the drive circuitry of the light sources (or in some other way), which can be challenging and/or expensive, the color point of the output light can shift with changes in operating parameters.

There exist lighting devices that comprise one or more light emitters that emit bluish-yellow light (the "bluish-yellow light emitters") and one or more light emitters that emit red light (the "red light emitters" or the "red light emitting diodes"), in which the light output from the respective light emitters is mixed to produce output light (intended to be white light). These devices include a sensor that is responsive to only the bluish-yellow light. These devices further include a thermistor circuit to compensate the current supplied to the light emitters that emit red light based on the roll-off of light output with increasing temperature that occurs with the red light emitting diodes. In these devices, the current supplied to the red light emitting diodes is adjusted based on the brightness of the bluish yellow-light detected by the sensor, and based on a prediction of the performance of the red light emitting diodes (based on the temperature detected by the thermistor), in an attempt to maintain the color point of the light emitted by the lighting device. (see, e.g., LR6, LR24, LRP38 products available from Cree, Inc. (and described at www.cree.com/products.aspx; also, see:

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/469,819, filed on May 21, 2009 (now U.S. Patent Publication No. 2010-0102199), the entirety of which is hereby incorporated by reference as if set forth in its entirety;

U.S. patent application Ser. No. 11/755,149, filed May 30, 2007 (now U.S. Patent Publication No. 2007/0278974), the entirety of which is hereby incorporated by reference as if set forth in its entirety;

U.S. Patent Application No. 61/245,688, filed on Sep. 25, 2009, the entirety of which is hereby incorporated by reference as if set forth in its entirety;

International Patent Application No. PCT/US10/49564, (now PCT Publication No. WO/2011/037877), filed Sep. 21, 2010, the entirety of which is hereby incorporated by reference as if set forth in its entirety;

U.S. patent application Ser. No. 12/541,215, filed on Aug. 14, 2009 (now U.S. patent Publication No. 2011-0037409), the entirety of which is hereby incorporated by reference as if set forth in its entirety;

U.S. patent application Ser. No. 12/469,828, filed on May 21, 2009 (now U.S. Patent Publication No. 2010-0103678), the entirety of which is hereby incorporated by reference as if set forth in its entirety; and U.S. patent application Ser. No. 12/475,850, filed on Jun. 1, 2009 (now U.S. Patent Publication No. 2009-0296384), the entirety of which is hereby incorporated by reference as if set forth in its entirety.

The LR6, LR24 and LRP38 products are tuned to a specific color point at the factory.

In many cases, the bluish-yellow light emitters in the LR6, LR24 and/or LRP38 products degrade (i.e., decrease in their brightness, all other conditions being equal) more rapidly than the red light emitting diodes. If in a specific lighting device the red light emitting diodes degrade more rapidly than the bluish-yellow light emitters, the mapping of the current to output of the red light emitting diodes can be incorrect and/or can change over time, as a result of which the circuit that is included to maintain the color point of the output light may actually end up altering the color point.

There is an ongoing effort to develop systems that are more energy-efficient. A large proportion (some estimates are as high as twenty-five percent) of the electricity generated in the United States each year goes to lighting, a large portion of which is general illumination (e.g., downlights, flood lights, spotlights and other general residential or commercial illumination products). Accordingly, there is an ongoing need to provide lighting that is more energy-efficient.

Solid state light emitters (e.g., light emitting diodes) are receiving much attention due to their energy efficiency. It is well known that incandescent light bulbs are very energy-inefficient light sources—about ninety percent of the electricity they consume is released as heat rather than light. Fluorescent light bulbs are more efficient than incandescent light bulbs (by a factor of about 10) but are still less efficient than solid state light emitters, such as light emitting diodes.

In addition, as compared to the normal lifetimes of solid state light emitters, e.g., light emitting diodes, incandescent light bulbs have relatively short lifetimes, i.e., typically about 750-1000 hours. In comparison, light emitting diodes, for example, have typical lifetimes between 50,000 and 70,000 hours. Fluorescent bulbs have longer lifetimes than incandescent lights (e.g., fluorescent bulbs typically have lifetimes of 10,000-20,000 hours), but provide less favorable color reproduction. The typical lifetime of conventional fixtures is about 20 years, corresponding to a light-producing device usage of at least about 44,000 hours (based on usage of 6 hours per day for 20 years). Where the light-producing device lifetime of the light emitter is less than the lifetime of the fixture, the need for periodic change-outs is presented. The impact of the need to replace light emitters is particularly pronounced where access is difficult (e.g., vaulted ceilings, bridges, high buildings, highway tunnels) and/or where change-out costs are extremely high.

LED lighting systems can offer a long operational lifetime relative to conventional incandescent and fluorescent bulbs. LED lighting system lifetime is typically measured by an "L70 lifetime", i.e., a number of operational hours in which the light output of the LED lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein.

LEDs also may be energy efficient, so as to satisfy ENERGY STAR® program requirements. ENERGY STAR program requirements for LEDs are defined in "*ENERGY STAR® Program Requirements for Solid State Lighting Luminaires, Eligibility Criteria—Version* 1.1", Final: Dec. 19, 2008, the disclosure of which is hereby incorporated herein by reference in its entirety as if set forth fully herein.

General illumination devices are typically rated in terms of their color reproduction. Color reproduction is typically measured using the Color Rendering Index (CRI Ra). CRI Ra is a modified average of the relative measurements of how the color rendition of an illumination system compares to that of a reference radiator when illuminating eight reference colors, i.e., it is a relative measure of the shift in surface color of an object when lit by a particular lamp. The CRI Ra equals 100 if the color coordinates of a set of test colors being illuminated by the illumination system are the same as the coordinates of the same test colors being irradiated by the reference radiator.

Daylight has a high CRI (Ra of approximately 100), with incandescent bulbs also being relatively close (Ra greater than 95), and fluorescent lighting being less accurate (typical Ra of 70-80). Certain types of specialized lighting have very low CM (e.g., mercury vapor or sodium lamps have Ra as low as about 40 or even lower). Sodium lights are used, e.g., to light highways—driver response time, however, significantly decreases with lower CRI Ra values (for any given brightness, legibility decreases with lower CRI Ra).

In order to encourage development and deployment of highly energy efficient solid state lighting (SSL) products to replace several of the most common lighting products currently used in the United States, including 60-Watt A19 incandescent and PAR 38 halogen incandescent lamps, the Bright Tomorrow Lighting Competition (L Prize™) has been authorized in the Energy Independence and Security Act of 2007 (EISA). The L Prize is described in "*Bright Tomorrow Lighting Competition* (*L Prize*™)", May 28, 2008, Document No. 08NT006643, the disclosure of which is hereby incorporated herein by reference in its entirety as if set forth fully herein. The L Prize winner must conform to many product requirements including light output, wattage, color rendering index, correlated color temperature, expected lifetime, dimensions and base type.

The color of visible light output by a light emitter, and/or the color of blended visible light output by a plurality of light emitters can be represented on either the 1931 CIE (Commission International de I'Eclairage) Chromaticity Diagram or the 1976 CIE Chromaticity Diagram. Persons of skill in the art are familiar with these diagrams, and these diagrams are readily available (e.g., by searching "CIE Chromaticity Diagram" on the internet).

The CIE Chromaticity Diagrams map out the human color perception in terms of two CIE parameters x and y (in the case of the 1931 diagram) or u' and v' (in the case of the 1976 diagram). Each point (i.e., each "color point") on the respective Diagrams corresponds to a particular hue. For a technical description of CIE chromaticity diagrams, see, for example, "Encyclopedia of Physical Science and Technology", vol. 7, 230-231 (Robert A Meyers ed., 1987). The spectral colors are distributed around the boundary of the outlined space, which includes all of the hues perceived by the human eye. The boundary represents maximum saturation for the spectral colors.

The 1931 CIE Chromaticity Diagram can be used to define colors as weighted sums of different hues. The 1976 CIE Chromaticity Diagram is similar to the 1931 Diagram, except that similar distances on the 1976 Diagram represent similar perceived differences in color.

The expression "hue", as used herein, means light that has a color shade and saturation that correspond to a specific point on a CIE Chromaticity Diagram, i.e., a point that can be characterized with x,y coordinates on the 1931 CIE Chromaticity Diagram or with u', v' coordinates on the 1976 CIE Chromaticity Diagram.

In the 1931 Diagram, deviation from a point on the Diagram (i.e., "color point") can be expressed either in terms of the x, y coordinates or, alternatively, in order to give an indication as to the extent of the perceived difference in color, in terms of MacAdam ellipses. For example, a locus of points defined as being ten MacAdam ellipses from a specified hue defined by a particular set of coordinates on the 1931 Diagram consists of hues that would each be perceived as differing from the specified hue to a common extent (and likewise for loci of points defined as being spaced from a particular hue by other quantities of MacAdam ellipses).

A typical human eye is able to differentiate between hues that are spaced from each other by more than seven MacAdam ellipses (but is not able to differentiate between hues that are spaced from each other by seven or fewer MacAdam ellipses).

Since similar distances on the 1976 Diagram represent similar perceived differences in color, deviation from a point on the 1976 Diagram can be expressed in terms of the coordinates, u' and v', e.g., distance from the point=$(\Delta u'^2+\Delta v'^2)^{1/2}$. This formula gives a value, in the scale of the u' v' coordinates, corresponding to the distance between points. The hues defined by a locus of points that are each a common distance from a specified color point consist of hues that would each be perceived as differing from the specified hue to a common extent. Accordingly, the expression "a first color point that is within 0.01 delta u', v' of a second color point" means that the distance between the first color point and the second color point is not more than 0.01 in the scale of the u' and v' coordinates in a 1976 CIE Chromaticity Diagram, i.e., the square root of (the sum of the square of the difference in the respective u' coordinates and the square of the difference in the respective v' coordinates) is not more than 0.01, and analogous expressions have analogous meanings.

A series of points that is commonly represented on the CIE Diagrams is referred to as the blackbody locus. The chromaticity coordinates (i.e., color points) that lie along the blackbody locus obey Planck's equation: $E(\lambda)=A\lambda^{-5}/(e^{(B/T)}-1)$, where E is the emission intensity, λ is the emission wavelength, T is the color temperature of the blackbody and A and B are constants. The 1976 CIE Diagram includes temperature listings along the blackbody locus. These temperature listings show the color path of a blackbody radiator that is caused to increase to such temperatures. As a heated object becomes incandescent, it first glows reddish, then yellowish, then white, and finally blueish. This occurs because the wavelength associated with the peak radiation of the blackbody radiator becomes progressively shorter with increased temperature, consistent with the Wien Displacement Law. Illuminants that produce light that is on or near the blackbody locus can thus be described in terms of their color temperature.

The emission spectrum of any particular light emitting diode is typically concentrated around a single wavelength (as dictated by the light emitting diode's composition and structure), which is desirable for some applications, but not desirable for others, (e.g., for providing general illumination, such an emission spectrum by itself would provide a very low CRI Ra).

In many situations (e.g., lighting devices used for general illuminations), the color of light output that is desired differs from the color of light that is output from a single solid state light emitter, and so in many of such situations, combinations of two or more types of solid state light emitters that emit light of different hues are employed. Where such combinations are used, there is often a desire for the light output from the lighting device to have a particular degree of uniformity, i.e., to reduce the variance of the color of light emitted by the lighting device at a particular minimum distance or distances. For example, there may be a desire for "pixelation", the existence of visually perceptible differences in hues in the output light, to be reduced or eliminated at a particular distance (e.g., 18 inches) from a lighting device (e.g., by holding up a sheet of white paper and seeing whether different hues can be perceived), i.e., for adequate mixing of the light emitted by emitters that emit light of different hues to be achieved.

The most common type of general illumination is white light (or near white light), i.e., light that is close to the blackbody locus, e.g., within about 10 MacAdam ellipses of the blackbody locus on a 1931 CIE Chromaticity Diagram. Light with such proximity to the blackbody locus is referred to as "white" light in terms of its illumination, even though some light that is within 10 MacAdam ellipses of the blackbody locus is tinted to some degree, e.g., light from incandescent bulbs is called "white" even though it sometimes has a golden or reddish tint; also, if the light having a correlated color temperature of 1500 K or less is excluded, the very red light along the blackbody locus is excluded.

Light that is perceived as white can be made by blending two or more hues (or wavelengths).

"White" solid state light emitting lamps have been produced by providing devices that mix different colors of light, e.g., by using light emitting diodes that emit light of differing respective colors and/or by converting some or all of the light emitted from the light emitting diodes using luminescent material. For example, as is well known, some lamps (referred to as "RGB lamps") use red, green and blue light emitting diodes, and other lamps use (1) one or more light emitting diodes that generate blue light and (2) luminescent material (e.g., one or more phosphor materials) that emits yellow light in response to excitation by light emitted by the light emitting diode, whereby the blue light and the yellow light, when mixed, produce light that is perceived as white light. While there is a need for more efficient white lighting, there is in general a need for more efficient lighting in all hues.

Accordingly, there is an ongoing need for light sources that are more efficient than existing options and that provide good CRI Ra over the lifetime of the light sources.

BRIEF SUMMARY

In one aspect, the present inventive subject matter provides lighting devices that comprise at least two color sensors, including at least a first color sensor that detects the brightness of light of a first color and at least a second color sensor that detects the brightness of light of a second color.

In a representative group of embodiments, the first color is bluish-yellow (e.g., BSY light, defined below) and the second color is red (or orange), at least a first sensor is sensitive to bluish-yellow light (e.g., BSY light), at least a second sensor is sensitive to red light, and the first sensor(s) and the second sensor(s) are used to maintain the ratio of bluish-yellow light and red light by controlling the current supplied to the light emitter(s) that emit red light (with the current supplied to the light emitter(s) that emit bluish-yellow light being constant, or changing less frequently so that the red light can be adjusted quickly enough to provide mixed output light that is within the desired output light color range a sufficient portion of the time. In some of such embodiments, the current supplied to the light emitter(s) that emit red light can have an upper limit to avoid overloading the power supply. In some of such embodiments, thermistor and temperature control circuitry can be eliminated (i.e., in such embodiments, a thermistor and temperature control circuitry do not need to be included). In some embodiments, at least one full spectrum sensor can be provided in order to monitor and/or limit the overall light output level (e.g., to keep control loops for the two light hues from running away), or the total amplitude of the bluish-yellow sensor(s) (i.e., the sensor(s) that are sensitive to bluish-yellow light) and the red sensor(s) (i.e., the sensor(s) that are sensitive to red light) can be used to approximate the total lumens, and the brightnesses of both colors can be controlled (e.g., if the total lumens is calculated to be excessive, the brightnesses of both colors can be reduced, and vice-versa).

In another aspect, the present inventive subject matter provides a lighting device that comprises:

at least a first light emitter that emits light having a first color point; and at least a second light emitter that emits light having a second color point.

In another aspect, the present inventive subject matter provides a lighting device that comprises:

at least a first sensor that detects brightness of at least light that is within 0.01 delta u', v' of the first color point; and at least a second sensor that detects brightness of at least light that is within 0.01 delta u', v' of the second color point.

in another aspect, the present inventive subject matter provides a lighting device that comprises:

at least a first light emitter that emits light of a first color;

at least a second light emitter that emits light of a second color;

at least a first sensor that detects brightness of at least light of the first color; and at least a second sensor that detects brightness of at least light of the second color.

In another aspect, the present inventive subject matter provides a lighting device that comprises:

at least a first light emitter and a second light emitter, in which the first light emitter emits light having a color point that is spaced at least 0.05 delta u', v' from the first color point;

at least a first sensor that detects brightness of at least light that is emitted by the first light emitter; and at least a second sensor that detects brightness of at least light that is emitted by the second light emitter.

In accordance with a first aspect of the present inventive subject matter, there is provided a lighting device that comprises:

at least a first light emitter that emits light having a first color point;

at least a second light emitter that emits light having a second color point;

at least a first sensor that detects brightness of at least light that is within 0.01 delta u', v' of the first color point; and at least a second sensor that detects brightness of at least light that is within 0.01 delta u', v' of the second color point.

In some embodiments in accordance with the first aspect of the present inventive subject matter, the lighting device comprises:

at least a first light emitter that emits light having a color point that is within 0.01 delta u', v' of a first color point on a 1976 CIE Chromaticity Diagram;

at least a second light emitter that emits light having a color point that is within 0.01 delta u', v' of a second color point on a 1976 CIE Chromaticity Diagram, the second color point spaced at least 0.05 delta u', v' from the first color point.

In some embodiments in accordance with the first aspect of the present inventive subject matter:

the lighting device comprises at least a first string and a second string;

a first plurality of light emitters are on the first string, so that when current is supplied to the first string, energy is supplied to the first plurality of light emitters;

a second plurality of light emitters are on the second string, so that when current is supplied to the second string, energy is supplied to the second plurality of light emitters;

a first ratio is equal to (1) the number of light emitters in the first plurality of light emitters that emit light having a color point that is within 0.01 delta u', v' of the first color point divided by (2) the number of light emitters in the first plurality of light emitters that emit light having a color point that is within 0.01 delta u', v' of the second color point, a second ratio is equal to (1) the number of light emitters in the second plurality of light emitters that emit light having a color point that is within 0.01 delta u', v' of the first color point divided by (2) the number of light emitters in the second plurality of light emitters that emit light having a color point that is within 0.01 delta u', v' of the second color point, and the first ratio is greater than the second ratio.

The expression "string", as used herein, means that at least two solid state light emitters are electrically connected in series. The expression "on a string" (and similar and/or analogous expressions, e.g., "a first plurality of light emitters are on the first string") means that the light emitters that are characterized as being "on" the string can be supplied with energy when energy is supplied to the string, e.g., the light emitters that are "on" the string are connected in series along a wire.

In some embodiments in accordance with the first aspect of the present inventive subject matter, the lighting device further comprises at least a first controller that controls current supplied to at least the second light emitter based on a ratio of the brightness detected by the first sensor divided by the brightness detected by the second sensor. In some of such embodiments:

the lighting device further comprises at least a first current limiter that limits current supplied to at least the second light emitter;

the lighting device further comprises at least a first spectrum sensor that detects a total brightness of all visible light hues (saturated and unsaturated); and/or the lighting device further comprises at least a first limit controller that limits current supplied to at least one of the first and second light emitters based on the brightness detected by the first spectrum sensor.

In some embodiments in accordance with the first aspect of the present inventive subject matter, the lighting device further comprises at least a first current limiter that limits current supplied to at least the second light emitter.

In some embodiments in accordance with the first aspect of the present inventive subject matter, the first color point is within the scope of BSY light (defined below); and the second color point has a dominant wavelength in the range of from about 600 nm to about 700 nm (e.g., in the range of from about 600 nm to about 630 nm) (and in some of such cases, the second color point can be saturated light).

In some embodiments in accordance with the first aspect of the present inventive subject matter, when current is supplied to the lighting device, a mixture of light exiting the lighting device is white light.

In some embodiments in accordance with the first aspect of the present inventive subject matter, a mixture of (1) light emitted by the at least a first light emitter that emits light having a first color point and (2) light emitted by the at least a second light emitter that emits light having a second color point is white light.

In some embodiments in accordance with the first aspect of the present inventive subject matter, the lighting device further comprises at least a first spectrum sensor that detects a total brightness of all visible light hues. In some of such embodiments:

the lighting device further comprises at least a first limit controller that limits current supplied to at least one of the first and second light emitters based on the brightness detected by the first spectrum sensor; and/or the lighting device further comprises a dimmer, the dimmer can be adjusted to select a maximum brightness and the first limit controller reduces the current supplied to at least one of the first and second light emitters if the brightness detected by the first spectrum sensor exceeds the maximum brightness.

In some embodiments in accordance with the first aspect of the present inventive subject matter, the lighting device further comprises at least a first dimmer.

In accordance with a second aspect of the present inventive subject matter, there is provided a method that comprises:

supplying energy to at least a first light emitter that emits light having a first color point;

supplying energy to at least a second light emitter that emits light having a second color point, the second color point different from the first color point;

detecting brightness of at least light that is within 0.01 delta u', v' of the first color point; and detecting brightness of at least light that is within 0.01 delta u', v' of the second color point.

In some embodiments in accordance with the second aspect of the present inventive subject matter, the method comprises:

supplying energy to at least a first light emitter that emits light having a color point that is within 0.01 delta u', v' of a first color point on a 1976 CIE Chromaticity Diagram;

supplying energy to at least a second light emitter that emits light having a color point that is within 0.01 delta u', v' of a second color point on a 1976 CIE Chromaticity Diagram, the second color point spaced at least 0.05 delta u', v' from the first color point;

detecting brightness of at least light that is within 0.01 delta u', v' of the first color point; and detecting brightness of at least light that is within 0.01 delta u', v' of the second color point.

In some embodiments in accordance with the second aspect of the present inventive subject matter, the method further comprises controlling current supplied to at least the second light emitter based on a ratio of (1) the brightness of at least light that is within 0.01 delta u', v' of the first color point detected by a first sensor to (2) the brightness of at least light that is within 0.01 delta u', v' of the second color point detected by a second sensor. In some of such embodiments:

the method further comprises limiting current supplied to at least the second light emitter;

the method further comprises detecting a total brightness of all visible light hues; and/or the method further comprises limiting current supplied to at least one of the first and second light emitters based on the brightness of all visible light hues detected by a first spectrum sensor.

In some embodiments in accordance with the second aspect of the present inventive subject matter, the method further comprises limiting current supplied to at least the second light emitter.

In some embodiments in accordance with the second aspect of the present inventive subject matter:

the first color point is within the scope of BSY light (defined below); and the second color point is light having a dominant wavelength in the range of from about 600 nm to about 700 nm (e.g., in the range of from about 600 nm to about 630 nm) (and in some of such cases, the second color point can be saturated light).

In some embodiments in accordance with the second aspect of the present inventive subject matter, a mixture of light exiting the lighting device is white light.

In some embodiments in accordance with the second aspect of the present inventive subject matter, a mixture of (1) light emitted by the at least a first light emitter that emits light having a first color point and (2) light emitted by the at least a second light emitter that emits light having a second color point that is within 0.01 delta u', v' of a second color point on a 1976 CIE Chromaticity Diagram is white light.

In some embodiments in accordance with the second aspect of the present inventive subject matter, the method further comprises detecting a total brightness of all visible light hues. In some of such embodiments:

the method further comprises limiting current supplied to at least one of the first and second light emitters based on the total brightness of all visible light hues detected by a first spectrum sensor; and/or the method further comprises reducing the current supplied to at least one of the first and second light emitters if the brightness detected by the first spectrum sensor exceeds a maximum brightness set on a dimmer.

In some embodiments in accordance with the second-aspect of the present inventive subject matter, the method further comprises reducing the current supplied to at least one of the first and second light emitters if the brightness detected by the first spectrum sensor exceeds a maximum brightness set on a dimmer.

The inventive subject matter may be more fully understood with reference to the accompanying drawings and the following detailed description of the inventive subject matter.

BRIEF DESCRIPTION OF THE DRAWING FIGURES

DETAILED DESCRIPTION

Figure 1:
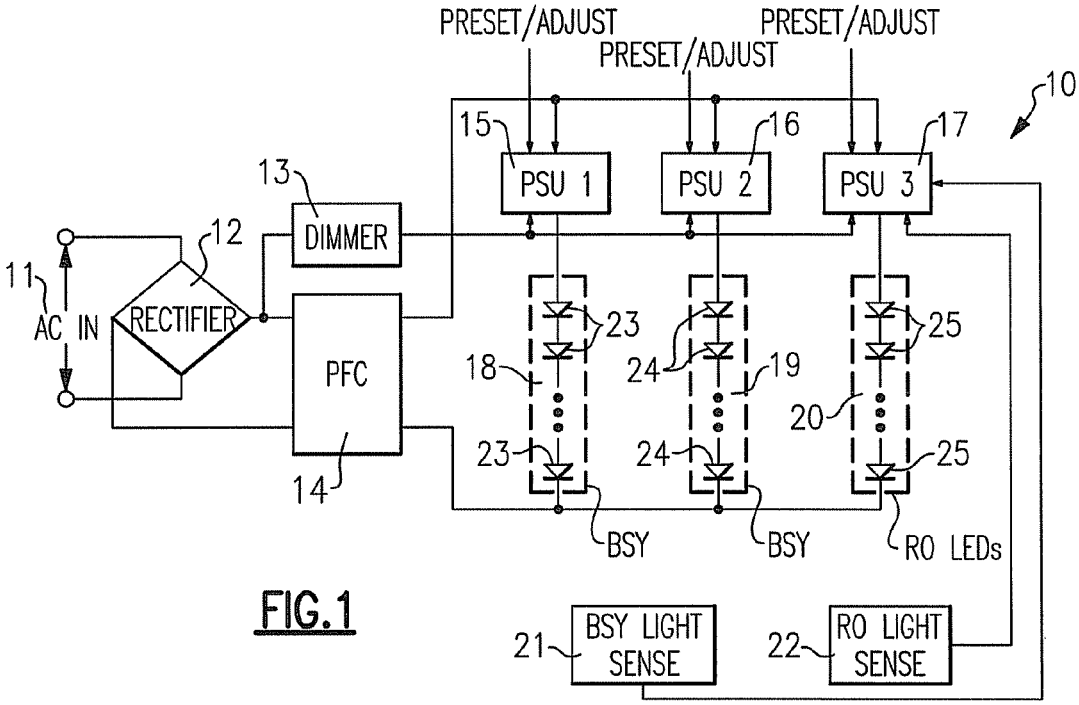
FIG. 1 is a block diagram of a lighting device 10 in accordance with the present inventive subject matter.

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout.

As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on", being mounted "to", or extending "onto" another element, it can be in or on the other element, and/or it can be directly on the other element, and/or it can extend directly onto the other element, and it can be in direct contact or indirect contact with the other element (e.g., intervening elements may also be present). In contrast, when an element is referred to herein as being "directly on" or extending "directly onto" another element, there are no intervening elements present. Also, when an element is referred to herein as being "connected" or "coupled" to another element, it can be directly connected or coupled to the other element, or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top", "above," "horizontal" or "vertical" may be used herein to describe one element's relationship to another element (or to other elements) as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower" can therefore encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can therefore encompass both an orientation of above and below.

The expression "defined (at least in part)", e.g., as used in the expression "the mixing chamber is defined (at least in part) by a mixing chamber element and a lens and/or a diffuser" means that the element or feature that is defined "at least in part" by a particular structure is defined completely by that structure or is defined by that structure in combination with one or more additional structures.

The expression "illumination" (or "illuminated"), as used herein when referring to a light emitter, means that at least some current is being supplied to the light emitter to cause the light emitter to emit at least some electromagnetic radiation (e.g., visible light). The expression "illuminated" encompasses situations where the light emitter emits electromagnetic radiation continuously, or intermittently at a rate such that a human eye would perceive it as emitting electromagnetic radiation continuously or intermittently, or where a plurality of light emitters of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting, work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

Some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

The term "saturated", as used herein, means having a purity of at least 85%, the term "purity" having a well known meaning to persons skilled in the art, and procedures for calculating purity being well known to those of skill in the art.

The expression "white light" (or similar or analogous expressions), as used herein, means light that has a color point that is spaced by at least a unit distance of not more than 0.01 (in the scale of u' v' coordinates) from the nearest point on the blackbody locus in a 1976 CIE Chromaticity Diagram.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, in a first aspect of the present inventive subject matter, there is provided a lighting device that comprises:

at least a first light emitter that emits light having a first color point;

at least a second light emitter that emits light having a second color point, the second color point different from the first color point;

at least a first sensor that detects brightness of at least light that is within 0.01 delta u', v' of the first color point; and at least a second sensor that detects brightness of at least light that is within 0.01 delta u', v' of the second color point.

Persons of skill in the art are familiar with, and have ready access to, a wide variety of light emitters of different hues, and any suitable light emitters can be employed in accordance with the present inventive subject matter.

Representative examples of types of light emitters include incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc., with or without filters. That is, the light emitters can comprise a plurality of light emitters of a particular type, or any combination of one or more light emitters of each of a plurality of types.

Persons of skill in the art are familiar with, and have ready access to, and can readily make, a variety of light emitters of any type that emit light having a desired hue (e.g., at or near particular color points which are known to those of skill in the art and/or that can readily be determined by well known techniques).

Persons of skill in the art are familiar with, and have ready access to, a wide variety of solid state light emitters (i.e., one of the types of light emitters mentioned above), and any suitable solid state light emitter (or solid state light emitters) can be employed as one or more of the light emitters in the lighting devices according to the present inventive subject matter. Representative examples of solid state light emitters include light emitting diodes (inorganic or organic, including polymer light emitting diodes (PLEDs)), and a wide variety of luminescent materials as well as combinations (e.g., one or more light emitting diodes and/or one or more luminescent materials).

Persons of skill in the art are familiar with, and have ready access to, and can readily make, a variety of solid state light emitters that emit light having a desired hue (e.g., at or near particular color points, peak emission wavelengths and/or dominant emission wavelengths), and any of such solid state light emitters, or any combinations of such solid state light emitters, can be employed in embodiments that comprise a solid state light emitter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) and/or the type of electromagnetic radiation (e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package (e.g., comprising an encapsulant) that encapsulates the light emitting diode.

A luminescent material is a material that emits a responsive radiation (e.g., visible light) when excited by a source of exciting radiation. In many instances, the responsive radiation has a wavelength (or hue) that is different from the wavelength (or hue) of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light. Persons of skill in the art are familiar with, and have ready access to, a variety of luminescent materials that emit light having a desired peak emission wavelength and/or dominant emission wavelength, or a desired hue, and any of such luminescent materials (discussed in more detail below), or any combinations of such luminescent materials, can be employed in embodiments that comprise luminescent material.

One non-limiting representative example of a luminescent material that can be employed in the present inventive subject matter is cerium-doped yttrium aluminum garnet (also known as "YAG:Ce" or "YAG"). Another non-limiting representative example of a luminescent material that can be employed in the present inventive subject matter is CaAlSiN:Eu2+ (also known as "CASN" or "BR01").

One or more luminescent materials, if included, can be provided in any suitable form. For example, one or more luminescent materials can be embedded in a resin (i.e., a polymeric matrix), such as a silicone material, an epoxy material, a glass material or a metal oxide material, and/or can be applied to one or more surfaces of a resin, to provide a lumiphor. For example, in some embodiments in accordance with the present inventive subject matter, a luminescent material-containing element (or elements) can be provided which comprises one or more substantially transparent materials with luminescent material dispersed within the substantially transparent material(s) and/or positioned on one or more surfaces of the substantially transparent material(s), and/or a luminescent material-containing element (or elements) can be provided which comprises one or more reflective (the expression "reflective", as used herein, encompasses light-reflecting as well as specular) materials (or at least partially reflective materials) and luminescent material (or materials) dispersed within the luminescent material-containing element and/or positioned on one or both surfaces of the luminescent material-containing element.

A wide variety of lumiphors are known to those skilled in the art. For example, a lumiphor can comprise (or can consist essentially of, or can consist of) one or more luminescent material. A lumiphor can, if desired, further comprise one or more highly transmissive (e.g., transparent or substantially transparent, or somewhat diffuse) binder, e.g., made of epoxy, silicone, glass, metal oxide, or any other suitable material (for example, in any given lumiphor comprising one or more binder, one or more luminescent material can be dispersed within the one or more binder—such a binder can be an encapsulant, discussed below). For example, the thicker the lumiphor, in general, the lower the weight percentage of the luminescent material can be. Depending on the overall thickness of the lumiphor, however, the weight percentage of the luminescent material could be generally any value, e.g., from 0.1 weight percent to 100 weight percent (e.g., a lumiphor formed by subjecting pure phosphor to a hot isostatic pressing procedure). Any lumiphor can further comprise any of a number of well known additives, e.g., diffusers, scatterers, tints, etc.

The light emitters in any lighting device according to the present inventive subject matter can be of any suitable size (or sizes), e.g., and any suitable quantity (or respective quantities) of light emitters of one or more sizes and/or types can be employed in the lighting device. In some instances, for example, a greater quantity of smaller solid state light emitters can be substituted for a smaller quantity of larger solid state light emitters, or vice-versa.

In some embodiments in accordance with the present inventive subject matter, including some embodiments that include or do not include any of the features described herein, one or more light emitters (e.g., one or more light emitting diodes, if included) can be provided that comprise one or more encapssulant element, which can be generally any at least partially translucent or partially transparent structure, and can be located anywhere that light emitted enters the encapssulant element(s). For example, an encapsulant element can completely surround a light emitter, an encapsulant element can substantially surround a light emitter, or an encapsulant element can not surround a light emitter (e.g., of all the directions extending from the light emitter and spaced at least five degrees from each other, any portion of such directions can pass through one or more encapsulant elements), and the encapsulant element(s) (if included) can be spaced from a light emitter, in indirect contact with a light emitter, or in direct contact with a light emitter. In some embodiments, an encapsulant element can protect one or more light emitter (e.g., one or more solid state light emitter). In embodiments that include one or more encapsulant elements, any number of the encapsulant elements can be removable. Persons of skill in the art are familiar with encapsulant elements, and are familiar with a wide range of materials that can be used to make encapsulant elements, sizes and shapes for encapsulant elements.

It is well known that light emitters that emit light of differing hues can be combined to generate mixtures of light that have desired hues (e.g., non-white light corresponding to desired color points or white light of desired color temperature, etc.). It is also well known that the color point produced by mixtures of colors can readily be predicted and/or designed using simple geometry on a CIE Chromaticity Diagram. It is further well known that starting with the notion of a desired mixed light color point, persons of skill in the art can readily select light emitters of different hues that will, when mixed, provide the desired mixed light color point. For example, persons of skill in the art can select a first light emitter (e.g., a light emitting diode with phosphor), plot the color point of the light it emits on a CIE Chromaticity Diagram, plot a desired range of color points (or a single desired color point) for mixed light, draw one or more line segments through the desired range of color points (or the single color point) for the mixed light such that the line segment(s) extend beyond the desired color point(s), and identify one or more second light emitters (e.g., a light emitting diode, a phosphor material, or a combination thereof) that emit light of color point(s) through which the line segment(s) pass (on a side of the desired mixed color point(s) that is opposite the color point of the first light emitter). The result is a plot of a line segment that originates at the color point for the first light emitter, that passes through the desired mixed light color point (or one of the range for the desired mixed light color point), and that terminates at the color point for the second light emitter. When the first light emitter and the second light emitter are energized so that they emit light, the color point of the mixed light will necessarily lie along the line segment, and the location of the color point of the mixed light along the line segment will be dictated by (namely, proportional to) the relative brightnesses of the respective light emitted from the first and second light emitters. That is, the greater the proportion of the mixed light that is from the second light emitter, the closer the color point is to the color point of the second light emitter; this relationship is geometrically proportional, i.e., the fraction of the length of the line segment that the color point of the mixed light is spaced from the color point of the first light emitter is equal to the fraction of the mixed light that is from the second light emitter (and vice-versa), or, in geometric terms, the ratio of (1) the distance from the color point of the first light emitter to the color point of the mixed light, divided by (2) the distance from the color point of the first light emitter to the color point of the second light emitter will be equal to the ratio of the brightness (in lumens) of the first light emitter divided by the brightness (in lumens) of the combination of light in the mixed light. Accordingly, once one identifies light emitters that provide the endpoints of a line segment that extends through the desired mixed light color point, the desired mixed light color point can be obtained by calculating the relative brightnesses of the first and second light emitters necessary to arrive at the desired mixed light color point.

Where more than two light emitters are used (i.e., where there are mixed light of a first color point from a first light emitter, light of a second color point from a second light emitter, and light of a third color point from a third light emitter), the geometrical relationships can be used to ensure that the desired mixed light color point is obtained (e.g., conceptually the color point of a sub-mixture of light from the first light emitter and the second light emitter can be determined, and then the color point of a mixture of sub-mixture (having a brightness of the combined brightnesses of the first light emitter and the second light emitter) and the third light emitter can be determined), and the range of mixed light color points that can be reached is defined by the perimeter obtained from drawing lines connecting the respective color points of the light emitters.

In general, light of any combination and number of colors can be mixed in lighting devices according to the present inventive subject matter. Representative examples of blends of light colors are described in:

U.S. Pat. No. 7,213,940, issued on May 8, 2007, the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety; and U.S. patent application Ser. No. 12/475,850, filed on Jun. 1, 2009 (now U.S. Patent Publication No. 2009-0296384), the entirety of which is hereby incorporated by reference as if set forth in its entirety.

Light emitters can thus be used individually or in any combinations, optionally together with one or more filters, to generate light of any desired perceived color (including white).

In some embodiments of the present inventive subject matter, including some embodiments that include or do not include any of the features as discussed herein, a combination of light exiting the lighting device has a CRI Ra of at least 80, in some cases at least 83, in some cases at least 85, in some cases at least 90, and in some cases at least 92.

The expression "BSY light", as used herein, means light having x, y color coordinates which define a point which is within (1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53 (in the 1976 CIE Chromaticity Diagram, the first point has u', v' coordinates of 0.17, 0.48, the second point has u', v' coordinates of 0.20, 0.48, the third point has u', v' coordinates of 0.22, 0.53, the fourth point has u', v' coordinates of 0.22, 0.55, and the fifth point has u', v' coordinates of 0.18, 0.55)

In some embodiments according to the present inventive subject matter, the lighting device comprises at least one light emitter that, if energized, emits BSY light (e.g., a solid state light emitter which can include one or more light emitting diodes and/or one or more luminescent materials), and at least one light emitter that, if energized, emits light that is not BSY light.

Persons of skill in the art are familiar with a wide variety of sensors that detect the brightness of light of particular color points or within ranges (or regions) of color points (including ranges that encompass all visible light), and any of such sensors can be employed in the lighting devices of the present inventive subject matter. For example, available sensors include a unique and inexpensive sensor (GaP:N light emitting diode) that views the entire light flux but is only (optically) sensitive to one or more of a plurality of light emitting diodes. Similarly, some types of sensors are excited by only light of a range that excludes red light (see, e.g., U.S. patent application Ser. No. 12/117,280, filed May 8, 2008 (now U.S. Patent Publication No. 2008/0309255), the entirety of which is hereby incorporated by reference as if set forth in its entirety.

In some embodiments in accordance with the present inventive subject matter, including some embodiments that include or do not include any of the features described herein, any sensor or sensors can be placed so as to be isolated from ambient light such that any such ambient light does not contribute to the light detected by the sensor(s).

In some embodiments in accordance with the present inventive subject matter, including some embodiments that include or do not include any of the features described herein, one or more sensors can be provided to detect ambient light, and the measured light output from the lighting device can be adjusted based on the measured ambient light (i.e., the measured light output from the lighting device might be deemed to include all or a portion of ambient light that was not emitted from the light emitters in the lighting device).

As noted above, in some embodiments in accordance with the first aspect of the present inventive subject matter, including some embodiments that include or do not include any of the features described herein, there can be provided at least a first controller that controls current supplied to at least the second light emitter based on a ratio of the brightness detected by the first sensor divided by the brightness detected by the second sensor.

Persons of skill in the art are familiar with, have access to, and can readily envision a variety of suitable types of circuitry components or combinations of components that can be used as controllers, to control current supplied to a light emitter based on a particular parameter (in this case, the ratio of the brightness detected by the first sensor divided by the brightness detected by the second sensor), and any of such controllers can be employed in the lighting devices in accordance with the present inventive subject matter. For example, a controller may be a digital controller, an analog controller or a combination of digital and analog. For example, the controller may be an application specific integrated circuit (ASIC), a microprocessor, a microcontroller, a collection of discrete components or combinations thereof. In some embodiments, control of the one or more light emitters may be provided by the circuit design of the controller and is, therefore, fixed at the time of manufacture. In other embodiments, aspects of the controller circuit, such as reference voltages, resistance values or the like, may be set at the time of manufacture so as to allow adjustment of the control of the one or more light emitters without the need for programming or control code.

As noted above, in some embodiments in accordance with the first aspect of the present inventive subject matter, including some embodiments that include or do not include any of the features described herein, there can be provided at least a first current limiter that limits current supplied to at least the second light emitter. Persons of skill in the art are familiar with a variety of circuitry components and combinations components that can be used to limit current supplied to a light emitter, and any of such components (or combinations of components) can be employed in the lighting devices in accordance with the present inventive subject matter.

As noted above, in some embodiments in accordance with the first aspect of the present inventive subject matter, including some embodiments that include or do not include any of the features described herein, there can be provided at least one sensor that detects a total brightness of all visible light hues (a "spectrum sensor") and at least a first limit controller that limits current supplied to at least one of the first and second light emitters based on the brightness detected by the spectrum sensor(s).

As discussed above, persons of skill in the art are familiar with sensors that detect a total brightness of all visible light hues. In addition, persons of skill in the art are familiar with circuitry components and combinations of circuitry components that can limit current supplied to one or more light emitters based on the brightness detected by one or more sensors, and any of such components (or combinations of components) can be employed in the lighting devices in accordance with the present inventive subject matter.

As noted above, in some embodiments in accordance with the first aspect of the present inventive subject matter, including some embodiments that include or do not include any of the features described herein, there can be provided at least a first dimmer. Persons of skill in the art are familiar with a variety of circuitry components and combinations of circuitry components that can be used as dimmers, and any of such components or combinations of components can be employed in the lighting devices in accordance with the present inventive subject matter.

In some embodiments in accordance with the present inventive subject matter, including some embodiments that include or do not include any of the features described herein, a dimmer can be provided that enables a user to adjust (or that automatically adjusts, based on some parameter, e.g., a programmed time pattern) current supplied to a first group of light emitters, and the current supplied to one or more other groups of light emitters is automatically adjusted to produce the desired color hue for the mixture of light output from the lighting device.

For example, in a representative embodiment that comprises a first string with bluish-yellow light emitters (and no other light emitters), a second string with bluish-yellow light emitters (and no other light emitters), and a third string with red light emitters (and no other light emitters), in which a first sensor detects the brightness of light emitted by the bluish-yellow light emitters and a second sensor detects the brightness of light emitted by the red light emitters, and in which the lighting device further comprises at least a first controller that controls current supplied to the red light emitters based on a ratio of the brightness detected by the first sensor divided by the brightness detected by the second sensor, a dimmer can be provided that adjusts the current supplied to the bluish-yellow light emitters (i.e., in order to dim the light from the lighting device, the current supplied to the bluish-yellow light emitters is reduced), and the controller will automatically adjust the current supplied to the red light emitters so that the lighting device emits the desired mixed output hue, with the result that the hue is maintained and the overall brightness of the mixed output light is reduced.

Alternatively, in a representative embodiment that comprises a first string with bluish-yellow light emitters (and no other light emitters), a second string with bluish-yellow light emitters (and no other light emitters), and a third string with red light emitters (and no other light emitters), in which a first sensor detects the brightness of light emitted by the bluish-yellow light emitters and a second sensor detects the brightness of light emitted by the red light emitters, and in which the lighting device further comprises at least a first controller that instead controls current supplied to the bluish-yellow light emitters based on a ratio of the brightness detected by the first sensor divided by the brightness detected by the second sensor, a dimmer can be provided that instead adjusts the current supplied to the red light emitters (i.e., in order to dim the light from the lighting device, the current supplied to the red light emitters is reduced), and the controller will automatically adjust the current supplied to the bluish-yellow light emitters so that the lighting device emits the desired mixed output hue, with the result that the hue is maintained and the overall brightness of the mixed output light is reduced.

Alternatively, one or more of the strings in the representative embodiments in the previous two paragraphs can have both bluish-yellow light emitters and red light emitters, and the ratio of bluish-yellow light emitters to red light emitters in at least one string can differ from the ratio of bluish-yellow light emitters to red light emitters in at least one other string, whereby the hue of the mixed output light from the lighting device can be adjusted by adjusting one or more of the respective currents supplied to the respective strings (e.g., a dimmer could reduce the current supplied to a string with a relatively higher proportion of red light emitters, and a controller could automatically reduce the current supplied to one or more other strings with relatively lower proportions of red light emitters, thereby reducing the overall brightness of the mixed output light.

Alternatively, in other representative embodiments, a dimmer can be provided that can be adjusted to select a maximum brightness of the mixed light output by the lighting device, and a limit controller can be provided that reduces the current supplied to at least one light emitter based on the adjustment of the maximum brightness of the mixed light output (e.g., based on a reduction in the selected maximum brightness, a limit controller reduces the current supplied to a string of red light emitters or a string that has a largest proportion of red light emitters), and a controller automatically reduces the current supplied to one or more other light emitters (e.g., strings of bluish-yellow light emitters or with relatively lower proportions of red light emitters) based on the ratio of the brightness of at least one color (e.g., red) to the brightness of at least one other color (e.g., bluish-yellow) (in order to maintain the color of the mixed output light), thereby reducing the overall brightness of the mixed output light.

Persons of skill in the art are familiar with a variety of types of dimmers. For example, dimming can be accomplished by reducing the current supplied to one or more light emitting diodes, by supplying a particular current to one or more light emitting diodes intermittently rather than continuously, and/or by reducing the proportion of time that intermittent current is supplied to one or more light emitting diodes.

In phase cut dimming, the leading or trailing edge of line voltage is manipulated to reduce the RMS voltage provided to a light emitter. When used with incandescent lamps, this reduction in RMS voltage results in a corresponding reduction in current and, therefore, a reduction in power consumption and light output.

In 0-10V and PWM dimming, a dimming signal separate from an AC signal is provided to a light emitter. In 0-10V dimming, the dimming signal is a voltage level between 0 and 10V DC. The light emitter has a 100% output at 10V DC and a minimum output at 1V DC. Additional details on 0-10V dimming can be found in IEC Standard 60929. 0-10V dimming is conventionally used to dim fluorescent lighting.

In PWM dimming, a square wave is provided as the dimming signal. The duty cycle of the square wave can be used to control the light output of the light emitter. For example, with a 50% duty cycle, the output of the light emitter(s) may be dimmed 50%. With a 75% duty cycle, the light output may be 75%. Thus, the light output of the light emitter may be proportional to the duty cycle of the input square wave.

Some embodiments in accordance with the present inventive subject matter can comprise a power line that can be electrically connected to a source of power (such as a branch circuit, an electrical outlet, a battery, a photovoltaic collector, etc.) and that can supply power to one or more of the light emitters in the lighting device (e.g., to a plurality of parallel strings). A power line can be any structure that can carry electrical energy and supply it to one or more light emitters. In some embodiments in accordance with the present inventive subject matter, including some embodiments that include or do not include any of the features described herein, a string of solid state light emitters, and/or an arrangement comprising a plurality of strings of solid state light emitters arranged in parallel, is/are arranged in series with a power line, such that current is supplied through a power line and is ultimately supplied to the string or strings. In some embodiments, power is supplied to a power line before and/or after going through a power supply.

In some embodiments in accordance with the present inventive subject matter, including some embodiments that include or do not include any of the features described herein, a ratio of (1) the quantity of light emitters that emit light of a first hue divided by (2) the quantity of light emitters that emit light of a second hue differ among two or more strings, whereby the ratio of the brightness of light emitted by light emitters that emit light of the first hue relative to the brightness of light emitted by light emitters that emit light of the second hue can be adjusted by adjusting the ratio of the amount of power supplied to one string relative to the amount of power supplied to another string. As an example, if equal currents are being supplied to (1) a first string on which forty bluish-yellow light emitters (and no other light emitters) are provided in series, (2) a second string on which forty bluish-yellow light emitters (and no other light emitters) are provided in series, and (3) a third string on which forty red light emitters (and no other light emitters) are provided, and then it is desired to adjust the output of the combined light from the three strings to be more reddish, the current supplied to the third string can be increased (and/or the current supplied to the first string and/or the current supplied to the second string can be decreased). As an additional example, if equal currents are being supplied to (1) a first string on which twenty-five bluish-yellow light emitters and fifteen red light emitters (and no other light emitters) are provided in series, (2) a second string on which twenty-five bluish-yellow light emitters and fifteen red light emitters (and no other light emitters) are provided in series, and (3) a third string on which thirty red light emitters and ten red light emitters (and no other light emitters) are provided, and then it is desired to adjust the output of the combined light from the three strings to be more reddish, the current supplied to the first string and/or the second string can be increased (and/or the current supplied to the third string can be decreased). In place of or in addition to reducing current on a string, it is possible to supply current intermittently (e.g., to reduce the overall time that current is being supplied in the course of intermittently supplying the current) in order to reduce the perceived brightness of light emitted from the light emitters on one or more strings, thereby adjusting the hue of the combined output light.

It should be noted that an arrangement of strings can be referred to herein as being "parallel", even though different voltages and/or currents may be applied to the respective strings.

The lighting devices of the present inventive subject matter can be arranged, mounted and supplied with electricity in any desired manner, and can be mounted on any suitable housing, fixture or other structure. Skilled artisans are familiar with a wide variety of arrangements, mounting schemes, power supplying apparatuses, housings and fixtures, and any such arrangements, schemes, apparatuses, housings and fixtures can be employed in connection with the present inventive subject matter. The lighting devices of the present inventive subject matter can be electrically connected (or selectively connected) to any suitable power source, persons of skill in the art being familiar with a variety of such power sources.

Persons of skill in the art are familiar with, and can envision, a wide variety of materials out of which a housing, fixture or other structure (if included) (on which or to which the lighting devices according to the present inventive subject matter can be mounted) can be constructed, and a wide variety of shapes for such housings, fixtures and other structures, and housings, fixtures and other structures made of any of such materials and having any of such shapes can be employed in accordance with the present inventive subject matter. In some embodiments that include a housing, at least a portion of the internal surface of the housing is highly reflective. As noted above, persons of skill in the art are familiar with, and can readily obtain, a wide variety of reflective materials, and any of such materials can be used in making such housings.

Some embodiments in accordance with the present inventive subject matter can include one or more mixing chamber element (which can comprise one or more separate elements and/or which can be part of a housing, a fixture or other structure), which defines at least a portion of a mixing chamber in which light from one or more light emitters can be mixed before exiting the lighting device. A mixing chamber element, when included, can be of any suitable shape and size, and can be made of any suitable material or materials. Representative examples of materials that can be used for making a mixing chamber element include, among a wide variety of other materials, spun aluminum, powder metallurgy formed aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments that include a mixing chamber element, the mixing chamber element can consist of or can comprise a reflective element (and/or one or more of its surfaces can be reflective). Such reflective elements (and surfaces) are well known and readily available to persons skilled in the art. A representative example of a suitable material out of which a reflective element can be made is a material marketed by Furukawa (a Japanese corporation) under the trademark MCPET®. In some embodiments that include a mixing chamber, the mixing chamber is defined (at least in part) by a mixing chamber element and a lens and/or a diffuser.

In some embodiments that include a mixing chamber, the mixing chamber is defined (at least in part) by a trim element (e.g., instead of or in addition to a mixing chamber element). In some embodiments that include a mixing chamber, the mixing chamber is defined (at least in part) by a trim element, along with a mixing chamber element, a lens and/or a diffuser.

Some embodiments in accordance with the present inventive subject matter (which can include or not include any of the features described elsewhere herein) can include one or more lenses, diffusers or light control elements. Persons of skill in the art are familiar with a wide variety of lenses, diffusers and light control elements, can readily envision a variety of materials out of which a lens, a diffuser, or a light control element can be made (e.g., polycarbonate materials, acrylic materials, fused silica, polystyrene, etc.), and are familiar with and/or can envision a wide variety of shapes that lenses, diffusers and light control elements can be. Any of such materials and/or shapes can be employed in a lens and/or a diffuser and/or a light control element in an embodiment that includes a lens and/or a diffuser and/or a light control element. As will be understood by persons skilled in the art, a lens or a diffuser or a light control element in a lighting device according to the present inventive subject matter can be selected to have any desired effect on incident light (or no effect), such as focusing, diffusing, etc. Any such lens and/or diffuser and/or light control element can optionally comprise one or more luminescent materials, e.g., one or more phosphor.

In embodiments in accordance with the present inventive subject matter that include a lens (or plural lenses), the lens (or lenses) can be positioned in any suitable location and orientation.

In embodiments in accordance with the present inventive subject matter that include a diffuser (or plural diffusers), the diffuser (or diffusers) can be positioned in any suitable location and orientation. In some embodiments, which can include or not include any of the features described elsewhere herein, a diffuser can be provided over a top or any other part of the lighting device, and the diffuser can optionally comprise one or more luminescent material (e.g., in particulate form) spread throughout a portion of the diffuser or an entirety of the diffuser. One or more diffusers can enhance uniformity of light color emitted by a lighting device (and/or can provide a quantifiable degree of uniformity of color of light emission, e.g., light emitted from one or more light emitters emerging from each of at least 1000 non-overlapping square regions of a light exit surface have a color hue that is within 0.01 delta u', v' of a first color point on a 1976 CIE Chromaticity Diagram). In some situations, uniformity of emitted light color can be assessed based on whether or not the uniformity requirements of the L Prize are met. Persons of skill in the art are familiar with a variety of materials and structures that can be used to provide diffusion elements. A diffuser (also known as a diffusion element), if included, can be provided, for example, by a random array of light diffusing features, such as a randomly sized and/or spaced microlens array. For instance, a representative example of a suitable diffusion layer (if included) can be a Light Shaping Diffuser (LSD®), distributed by Liminit, which can provide 85%-92% transmission in a wide wavelength range of 360-1600 nm as described, for example, in a Liminit Datasheet entitled "*LED Lighting Applications*" and at the Liminit website at the IP address 216.154.222.249. Other representative examples of suitable low absorption diffusers, if included, can be one or more of the ADF series of diffusion films distributed by Fusion Optix, as described at fusionptix.com and in an article "*Lighting: Obscuration of LEDs*", diffusion films provided by ACEL, or diffusion films distributed by Bright View Technologies as described at brightviewtechologies.com.

In embodiments in accordance with the present inventive subject matter that include a light control element (or plural light control elements), the light control element (or light control elements) can be positioned in any suitable location and orientation. Persons of skill in the art are familiar with a variety of light control elements, and any of such light control elements can be employed.

In addition, one or more scattering elements (e.g., layers) can optionally be included in the lighting devices according to the present inventive subject matter. For example, a scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

The light emitters in a lighting device in accordance with the present inventive subject matter can be arranged in any suitable pattern.

Some embodiments according to the present inventive subject matter include solid state light emitters that emit BSY light and solid state light emitters that emit light that is not BSY light (e.g., red or reddish or reddish orange or orangish, or orange light), where each of the solid state light emitters that emit light that is not BSY light is surrounded by five or six solid state light emitters that emit BSY light.

In some embodiments, solid state light emitters (e.g., where a first group includes solid state light emitters that emit non-BSY light, e.g., red, reddish, reddish-orange, orangish or orange light, and a second group includes solid state light emitters that emit BSY light) may be arranged pursuant to a guideline described below in paragraphs (1)-(5), or any combination of two or more thereof, to promote mixing of light from light emitters emitting different colors of light:

(1) an array that has groups of first and second solid state light emitters with the first group of solid state light emitters arranged so that no two of the first group solid state light emitters are directly next to one another in the array;

(2) an array that comprises a first group of solid state light emitters and one or more additional groups of solid state light emitters, the first group of solid state light emitters being arranged so that at least three solid state light emitters from the one or more additional groups is adjacent to each of the solid state light emitters in the first group;

(3) an array is mounted on a submount, and the array comprises a first group of solid state light emitters and one or more additional groups of solid state light emitters, and the array is arranged so that less than fifty percent (50%), or as few as possible, of the solid state light emitters in the first group of solid state light emitters are on the perimeter of the array;

(4) an array comprises a first group of solid state light emitters and one or more additional groups of solid state light emitters, and the first group of solid state light emitters is arranged so that no two solid state light emitters from the first group are directly next to one another in the array, and so that at least three solid state light emitters from the one or more additional groups is adjacent to each of the solid state light emitters in the first group; and/or (5) an array is arranged so that no two solid state light emitters from the first group are directly next to one another in the array, fewer than fifty percent (50%) of the solid state light emitters in the first group of solid state light emitters are on the perimeter of the array, and at least three solid state light emitters from the one or more additional groups is adjacent to each of the solid state light emitters in the first group.

It is understood that light emitters in lighting devices in accordance with the present inventive subject matter can also be arranged in other ways, and can have additional features, that promote color mixing. In some embodiments, solid state light emitters can be arranged so that they are tightly packed, which can further promote natural color mixing. The lighting devices can also comprise different diffusers and reflectors to promote color mixing in the near field and in the far field.

In some embodiments in accordance with the present inventive subject matter, including some embodiments that include or do not include any of the features described herein, lighting devices in accordance with the present inventive subject matter can include one or more structures that assist in dissipating heat from the lighting devices. Persons of skill in the art are familiar with a wide variety of structures that can be used to assist in dissipating heat (which can be passive and/or active (i.e., energy is supplied to assist in dissipating heat)), and any of such structures, and combinations thereof, can be employed in the lighting devices in accordance with the present inventive subject matter.

A challenge with solid state light emitters is that the performance of many solid state light emitters may be reduced when they are subjected to elevated temperatures. For example, many light emitting diode light emitters have average operating lifetimes of decades (as opposed to just months or 1-2 years for many incandescent bulbs), but some light emitting diodes' lifetimes can be significantly shortened if they are operated at elevated temperatures. A common manufacturer recommendation is that the "junction temperature" (i.e., the temperature of the semiconductor junction of the LED) of a light emitting diode should not exceed 85 degrees C. if a long lifetime is desired. In order to ensure a junction temperature that is not above 85° C., various heat sinking schemes have been developed to dissipate at least some of the heat that is generated by the LED. See, for example, Application Note: CLD-APO6.006, entitled *Cree® XLamp® XR Family* & 4550 *LED Reliability*, published at cree.com/xlamp, September 2008.

In some aspects of the present inventive subject matter, which can include or not include any of the features described elsewhere herein, there are provided lighting devices that provide good heat dissipation (e.g., in some embodiments, sufficient that the lighting device can continue to provide at least 70% of its initial wall plug efficiency for at least 25,000 hours of operation of the lighting device, and in some cases for at least 35,000 hours or 50,000 hours of operation of the lighting device).

Energy can be supplied to the light emitters in the lighting devices from any source or combination of sources, for example, the grid (e.g., line voltage), one or more batteries, one or more photovoltaic energy collection devices (i.e., a device that includes one or more photovoltaic cells that convert energy from the sun into electrical energy), one or more windmills, etc.

The lighting devices according to the present inventive subject matter can further comprise any suitable electrical connector, a wide variety of which are familiar to those of skill in the art, e.g., an Edison connector (for insertion in an Edison socket), a GU24 connector, etc., or they may be directly wired to an electrical branch circuit. Other well known types of electrical connectors include 2-pin (round) GX5.3, can DC bay, 2-pin GY6.35, recessed single contact R7s, screw terminals, 4 inch leads, 1 inch ribbon leads, 6 inch flex leads, 2-pin GU4, 2-pin GU5.3, 2-pin G4, turn & lock GU7, GU10, G8, G9, 2-pin Pf, min screw E10, DC bay BA15d, min cand E11, med screw E26, mog screw E39, mogul bipost 038, ext. mog end pr GX16d, mod end pr GX16d and med skirted E26/50x39 (see https://www.gecatalogs.com/lighting/software/GELightingCatalogSetup.exe).

In some embodiments according to the present inventive subject matter, the lighting device can be a self-ballasted device. For example, in some embodiments, the lighting device can be directly connected to AC current (e.g., by being plugged into a wall receptacle, by being screwed into an Edison socket, by being hard-wired into a branch circuit, etc.).

Some embodiments of lighting devices according to the present inventive subject matter can comprise one or more power supply and/or one or more driver which can receive AC voltage (e.g., line voltage) and convert that voltage to a voltage and/or current suitable for driving solid state light emitters. Representative examples of power supplies for light emitting diode light emitters include linear current regulated supplies and/or pulse width modulated current and/or voltage regulated supplies.

In some embodiments in accordance with the present inventive subject matter that comprise a power supply, a power supply can comprise any electronic components that are suitable for a lighting device, for example, any of (1) one or more electrical components employed in converting electrical power (e.g., from AC to DC and/or from one voltage to another voltage), (2) one or more electronic components employed in driving one or more light emitter, e.g., running one or more light emitter intermittently and/or adjusting the current supplied to one or more light emitters in response to a user command, a detected change in intensity or color of light output, a detected change in an ambient characteristic such as temperature or background light, etc., and/or a signal contained in the input power (e.g., a dimming signal in AC power supplied to the lighting device), etc., (3) one or more circuit boards (e.g., a metal core circuit board) for supporting and/or providing current to any electrical components, and/or (4) one or more wires connecting any components (e.g., connecting an Edison socket to a circuit board), etc., e.g. electronic components such as linear current regulated supplies, pulse width modulated current and/or voltage regulated supplies, bridge rectifiers, transformers, power factor controllers etc.

A driver can comprise one or more electrical components employed in driving one or more light emitters, e.g., running one or more light emitters) intermittently and/or adjusting the current supplied to one or more light emitters in response to a user command, a detected change in brightness or color of light output, a detected change in an ambient characteristic such as temperature or background light, etc., and/or a signal contained in the input power (e.g., a dimming signal in AC power supplied to the lighting device).

In some embodiments, drive circuitry can be provided to achieve some degree of power factor correction. Persons of skill in the art are familiar with a variety of power factor controllers (PFCs), and any of such power factor controllers can be employed, if desired, in the lighting devices in accordance with the present inventive subject matter. In some embodiments, there can be provided a lighting device that may have a power factor of greater than 0.7 and in some embodiments a power factor of greater than 0.9. In some embodiments, a lighting device can have a power factor of greater than 0.5. Such embodiments may not require power factor correction and, therefore, may be less costly and smaller in size. Additionally, drive circuitry may be provided for dimming a lighting device.

Some embodiments according to the present inventive subject matter further comprise one or more printed circuit boards, on which one or more light emitters (e.g., one or more solid state light emitters) can be mounted. Persons of skill in the art are familiar with a wide variety of circuit boards, and any such circuit boards can be employed in the lighting devices according to the present inventive subject matter. One representative example of a circuit board with a relatively high heat conductivity is a metal core printed circuit board.

The various components in the lighting devices can be mounted in any suitable way. For example, in some embodiments, light emitters (e.g., light emitting diodes) can be mounted on a first circuit board (a "light emitter circuit board") and electronic circuitry that can convert AC line voltage into DC voltage suitable for being supplied to the light emitters can be mounted on a second circuit board (a "driver circuit board"), whereby line voltage is supplied to the electrical connector and passed along to the driver circuit board, the line voltage is converted to DC voltage suitable for being supplied to light emitters in the driver circuit board, and the DC voltage is passed along to the light emitter circuit board where it is then supplied to the light emitters.

In some embodiments according to the present inventive subject matter, light emitters are electrically arranged in series (e.g., in a string) with enough light emitters being present to match (or to come close to matching) the voltage supplied to the series of light emitters (e.g., in some embodiments, the DC voltage obtained by rectifying line AC current and supplying it to the light emitters via a power supply). For instance, in some embodiments, sixty-eight light emitting diodes (or other numbers, as needed to match the line voltage) can be arranged in series, so that the voltage drop across the entire series is about 162 volts. Providing such matching can help provide power supply efficiencies and thereby boost the overall efficiency of the lighting device. In such lighting devices, total lumen output can be regulated by adjusting the current supplied to the series of light emitting diodes.

In some embodiments according to the present inventive subject matter, including some embodiments that include or do not include any of the features as discussed herein, the lighting device has a wall plug efficiency of at least 25 lumens per watt, in some cases at least 35 lumens per watt, in some cases at least 50 lumens per watt, in some cases at least 60 lumens per watt, in some cases at least 70 lumens per watt, and in some cases at least 80 lumens per watt.

The expression "wall plug efficiency", as used herein, is measured in lumens per watt, and means lumens exiting a lighting device, divided by all energy supplied to create the light, as opposed to energy values for operating just individual components and/or assemblies of components. Accordingly, wall plug efficiency, as used herein, accounts for all losses, including, among others, any quantum losses, i.e., losses generated in converting line voltage into current supplied to light emitters, the ratio of the number of photons emitted by luminescent material(s) (if included) divided by the number of photons absorbed by the luminescent material (s), any Stokes losses, i.e., losses due to the change in frequency involved in absorption of light and re-emission of visible light (e.g., by luminescent material(s)), and any optical losses involved in the light emitted by a component of the lighting device actually exiting the lighting device. In some embodiments, the lighting devices in accordance with the present inventive subject matter provide the wall plug efficiencies specified herein when they are supplied with AC power (i.e., where the AC power is converted to DC power before being supplied to some or all components, the lighting device also experiences losses from such conversion), e.g., AC line voltage. The expression "line voltage" is used in accordance with its well known usage to refer to electricity supplied by an energy source, e.g., electricity supplied from a grid, including AC and DC.

In some embodiments in accordance with the present inventive subject matter, including some embodiments that include or do not include any of the features described herein, lighting devices in accordance with the present inventive subject matter can comprise one or more forward-transmitting optics and/or one or more reflective optics (including back reflective optics or forward reflecting optics), persons of skill in the art being familiar with and having access to a wide variety of such optics.

One or more brightness enhancement films can optionally be included in lighting devices according to the present inventive subject matter. Such films are well known in the art and are readily available. Brightness enhancement films (e.g., BEF films commercially available from 3M) are optional—when employed, they provide a more directional light emitter by limiting the acceptance angle. Light not "accepted" is recycled by a highly reflective enclosure. Preferably, brightness enhancement films (which can optionally be replaced by one or more extraction films, such as by WFT), if employed, are optimized to limit the viewing angle of the light emitter(s) and to increase the probability of extracting light on the first (or earliest possible) pass.

Persons of skill in the art are familiar with, and have ready access to, a wide variety of filters, and any suitable filter (or filters), or combinations of different types of filters, can be employed in accordance with the present inventive subject matter. Such filters can include (1) pass-through filters, i.e., filters in which light to be filtered is directed toward the filter, and some or all of the light passes through the filter (e.g., some of the light does not pass through the filter) and the light that passes through the filter is the filtered light, (2) reflection filters, i.e., filters in which light to be filtered is directed toward the filter, and some or all of the light is reflected by the filter (e.g., some of the light is not reflected by the filter) and the light that is reflected by the filter is the filtered light, and (3) filters that provide a combination of both pass-through filtering and reflection filtering.

Light emitting diode lighting systems can offer a long operational lifetime relative to conventional incandescent and fluorescent bulbs. Light emitting diode lighting system lifetime is typically measured by an "L70 lifetime", i.e., a number of operational hours in which the light output of the light emitting diode lighting system does not degrade by more than 30%. Typically, an L70 lifetime of at least 25,000 hours is desirable, and has become a standard design goal. As used herein, L70 lifetime is defined by Illuminating Engineering Society Standard LM-80-08, entitled "*IES Approved Method for Measuring Lumen Maintenance of LED Light Sources*", Sep. 22, 2008, ISBN No. 978-0-87995-227-3, also referred to herein as "LM-80", the disclosure of which is hereby incorporated herein by reference in its entirety as if set forth fully herein, and/or using the lifetime projections found in the ENERGY STAR Program Requirements cited above or described by the ASSIST method of lifetime prediction, as described in "*ASSIST Recommends . . . LED Life For General Lighting: Definition of Life*", Volume 1, Issue 1, February 2005, the disclosure of which is hereby incorporated herein by reference as if set forth fully herein.

In some aspects of the present inventive subject matter, which can include or not include any of the features described elsewhere herein, there are provided lighting devices that can provide an expected L70 lifetime of at least 25,000 hours. Lighting devices according to some embodiments of the present inventive subject matter provide expected L70 lifetimes of at least 35,000 hours, and lighting devices according to some embodiments of the present inventive subject matter provide expected L70 lifetimes of at least 50,000 hours.

In some embodiments according to the present inventive subject matter, the lighting device emits at least 600 lumens (in some embodiments at least 750 lumens, in some embodiments at least 800 lumens, in some embodiments at least 850 lumens, in some embodiments at least 900 lumens, at least 950 lumens, at least 1000 lumens, at least 1050 lumens or at least 1100 lumens) when the lighting device is energized (e.g., by supplying line voltage to the lighting device).

In some aspects of the present inventive subject matter, which can include or not include any of the features described elsewhere herein, there are provided lighting devices that provide sufficient lumen output (to be useful as a replacement for a conventional lamp), that provide good efficiency and that are within the size and shape constraints of a lamp for which the lighting device is a replacement. In some cases, "sufficient lumen output" means at least 75% of the lumen output of the lamp for which the lighting device is a replacement, and in some cases, at least 85%, 90%, 95%, 100%, 105%, 110%, 115%, 120% or 125% of the lumen output of the lamp for which the lighting device is a replacement.

The lighting devices according to the present inventive subject matter can direct light in any generally and desired range of directions. For instance, in some embodiments, the lighting device can direct light substantially omnidirectionally (i.e., substantially 100% of all directions extending from a center of the lighting device), i.e., within a volume defined by a two-dimensional shape in an x, y plane that encompasses rays extending from 0 degrees to 180 degrees relative to the y axis (i.e., 0 degrees extending from the origin along the positive y axis, 180 degrees extending from the origin along the negative y axis), the two-dimensional shape being rotated 360 degrees about the y axis (in some cases, the y axis can be a vertical axis of the lighting device). In some embodiments, the lighting device emits light substantially in all directions within a volume defined by a two-dimensional shape in an x, y plane that encompasses rays extending from 0 degrees to 150 degrees relative to the y axis (extending along a vertical axis of the lighting device), the two-dimensional shape being rotated 360 degrees about the y axis. In some embodiments, the lighting device emits light substantially in all directions within a volume defined by a two-dimensional shape in an x, y plane that encompasses rays extending from 0 degrees to 120 degrees relative to the y axis (extending along a vertical axis of the lighting device), the two-dimensional shape being rotated 360 degrees about the y axis. In some embodiments, the lighting device emits light substantially in all directions within a volume defined by a two-dimensional shape in an x, y plane that encompasses rays extending from 0 degrees to 90 degrees relative to the y axis (extending along a vertical axis of the lighting device), the two-dimensional shape being rotated 360 degrees about the y axis (i.e., a hemispherical region). In some embodiments, the two-dimensional shape can instead encompass rays extending from an angle in the range of from 0 to 30 degrees (or from 30 degrees to 60 degrees, or from 60 degrees to 90 degrees) to an angle in the range of from 90 to 120 degrees (or from 120 degrees to 150 degrees, or from 150 degrees to 180 degrees). In some embodiments, the range of directions in which the lighting device emits light can be non-symmetrical about any axis, i.e., different embodiments can have any suitable range of directions of light emission, which can be continuous or discontinuous (e.g., regions of ranges of emissions can be surrounded by regions of ranges in which light is not emitted). In some embodiments, the lighting device can emit light in at least 50% of all directions extending from a center of the lighting device (e.g., hemispherical being 50%), and in some embodiments at least 60%, 70%, 80%, 90% or more.

Each of the one or more light emitters in the lighting devices in accordance with the present inventive subject matter and/or the lighting devices themselves can be of any suitable shape, a variety of which are known to those of skill in the art, e.g., A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc. Within each of the lamp types identified in the previous sentence, numerous different varieties (or an infinite number of varieties) exist. For example, a number of different varieties of conventional A lamps exist and include those identified as A 15 lamps, A 17 lamps, A 19 lamps, A 21 lamps and A 23 lamps. The expression "A lamp" as used herein includes any lamp that satisfies the dimensional characteristics for A lamps as defined in ANSI C78.20-2003, including the conventional A lamps identified in the preceding sentence. The lamps according to the present inventive subject matter can satisfy (or not satisfy) any or all of the other characteristics for A lamps (defined in ANSI C78.20-2003), or for any other type of lamp.

Some representative examples of fowl factors include mini Multi-Mirror® projection lamps, Multi-Mirror® projection lamps, reflector projection lamps, 2-pin-vented base reflector projection lamps, 4-pin base CBA projection lamps, 4-pin base BCK projection lamps, DAT/DAK DAY/DAK incandescent projection lamps, DEK/DFW/DHN incandescent projection lamps, CAR incandescent projection lamps CAZ/CZB incandescent projection lamps, CZX/DAB incandescent projection lamps, DDB incandescent projection lamps, DRB DRC incandescent projection lamps, DRS incandescent projection lamps, BLX BLC BNF incandescent projection lamps, CDD incandescent projection lamps, CRX/CBS incandescent projection lamps, BAH BBA BCA ECA standard photofloods, EBW ECT standard photofloods, EXV EXX EZK reflector photofloods, DXC EAL reflector photofloods, double-ended projection lamps, G-6 G5.3 projection lamps, G-7 G29.5 projection lamps, G-7 2 button projection lamps, T-4 GY6.35 projection lamps, DFN/DFC/DCH/DJA/DFP incandescent projection lamps, DLD/DFZ GX17q incandescent projection lamps, DJL G17q incandescent projection lamps, DPT mog base incandescent projection lamps, lamp shape B (B8 cand, B10 can, B13 med), lamp shape C (C7 cand, C7 DC bay), lamp shape CA (CA8 cand, CA9 med, CA10 cand, CA10 med), lamp shape G (G16.5 cand, G16.5 DC bay, G16.5 SC bay, G16.5 med, G25 med, G30 med, G30 med skrt, G40 med, G40 mog) T6.5 DC bay, T8 disc (a single light engine module could be placed in one end, or a pair could be positioned one in each end), T6.5 inter, T8 med, lamp shape T (T4 cand, T4.5 cand, T6 cand, T6.5 DC bay, T7 cand, T7 DC bay, T7 inter, T8 cand, T8 DC bay, T8 inter, T8SC bay, T8 SC Pf, T10 med, T10 med Pf, T12 3C med, T14 med Pf, T20 mog bipost, T20 med bipost, T24 med bipost), lamp shape M (M14 med), lamp shape ER (ER30 med, ER39 med), lamp shape BR (BR30 med, BR40 med), lamp shape R (R14 SC bay, R14 inter, R20 med, R25 med, R30 med, R40 med, R40 med skrt, R40 mog, R52 mog), lamp shape P (P25 3C mog), lamp shape PS (PS25 3C mog, PS25 med, PS30 med, PS30 mog, PS35 mog, PS40 mog, PS40 mog Pf, PS52 mog), lamp shape PAR (PAR 20 med NP, PAR 30 med NP, PAR 36 scrw trim, PAR 38 skrt, PAR 38 med skrt, PAR38 med sid pr, PAR46 scrw trm, PAR46 mog end pr, PAR46 med sid pr, PAR56 scrw trm, PAR56 mog end pr, PAR56 mog end pr, PAR64 scrw trm, PAR64 ex mog end pr). (see https://www.gecatalogs.com/lighting/software/GELightingCatalogSetup.exe)(with respect to each of the form factors, a light engine module can be positioned in any suitable location, e.g., with its axis coaxial with an axis of the form factor and in any suitable location relative to the respective electrical connector).

Lighting devices according to the present inventive subject matter can comprise one or more light emitters of a particular shape and/or type or one or more light emitters of each of a plurality of different shapes and/or types.

The lighting devices in accordance with the present inventive subject matter can be designed to emit light in any suitable pattern, e.g., in the form of a flood light, a spotlight, a downlight, etc. Lighting devices according to the present inventive subject matter can comprise one or more light emitters that emit light in any suitable pattern, or one or more light emitters that emit light in each of a plurality of different patterns.

As noted above, in accordance with a second aspect of the present inventive subject matter, there is provide a method that comprises:

supplying energy to at least a first light emitter that emits light having a first color point;

supplying energy to at least a second light emitter that emits light having a second color point, the second color point different from the first color point;

detecting brightness of at least light that is within 0.01 delta u', v' of the first color point; and detecting brightness of at least light that is within 0.01 delta u', v' of the second color point.

The components and structures that can be employed in carrying out such methods (including methods that comprise additional features described herein) can include the components and structures described herein, as well as any other components and/or structures capable of carrying out, alone or in combinations, the features described for each of such methods.

The order in which detection of brightness of any light and any adjustments made (e.g., reducing the current supplied to one or more light emitters) can be carried out in any suitable order (or any groups of two or more activities can be carried out simultaneously, intermittently and/or alternatingly), and such order can be altered regularly or irregularly. The time span between any successive activities that occur at different times (e.g., the time span between detection and feedback adjustment) can be any suitable time span, and can be altered regularly or irregularly.

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

Certain embodiments of the present inventive subject matter are described with reference to flowchart illustrations. It should also be noted that in some alternate implementations, the functions/acts noted in the blocks in the flowchart(s) may occur out of the order noted in the flowcharts. For example, two blocks shown in succession may in fact be executed substantially concurrently or the blocks may sometimes be executed in the reverse order, depending upon the functionality/acts involved.

FIG. 1 is a block diagram of a lighting device 10 according to the present inventive subject matter. The lighting device 10 comprises a source of AC energy 11, a rectifier 12, a dimmer 13, a power factor controller 14, a first power supply unit 15, a second power supply unit 16, a third power supply unit 17, a first string 18 of light emitting diodes, a second string 19 of light emitting diodes, a third string 20 of light emitting diodes, a first sensor 21 and a second sensor 22.

The first string 18 of light emitting diodes comprises a plurality of LEDs 23 that emit BSY (each LED comprising a light emitting diode that emits blue light and luminescent material that emits yellowish-green light).

The second string 19 of light emitting diodes comprises a plurality of LEDs 24 that likewise emit BSY (each LED comprising a light emitting diode that emits blue light and luminescent material that emits yellowish-green light.

The third string 20 of light emitting diodes comprises a plurality of LEDs 25 that emit red light (or red-orange light).

Accordingly, the lighting device 10 depicted in FIG. 1 comprises:

a plurality of light emitters 23 and 24 that emit light having a color point that is within 0.01 delta u', v' of a first color point (namely a BSY color point) on a 1976 CIE Chromaticity Diagram;

a plurality of light emitters 25 that emit light having a color point that is within 0.01 delta u', v' of a second color point (namely a red or a red-orange hue) on a 1976 CIE Chromaticity Diagram, the second color point spaced more than 0.05 delta u', v' from the first color point;

a first sensor 21 that detects brightness of light that is within 0.01 delta u', v' of the first color point; and a second sensor 22 that detects brightness of light that is within 0.01 delta u', v' of the second color point.

The lighting device 10 comprises a first string 18, a second string 19 and a third string 20. A first plurality of light emitters 23 are on the first string 18, so that when current is supplied to the first string 18, energy is supplied to the first plurality of light emitters 23. A second plurality of light emitters 24 are on the second string 19, so that when current is supplied to the second string 19, energy is supplied to the second plurality of light emitters 24. A third plurality of light emitters 25 are on the third string 20, so that when current is supplied to the third string 20, energy is supplied to the third plurality of light emitters 25.

A first ratio is equal to (1) the number of light emitters in the first plurality of light emitters 23 that emit light having a color point that is within 0.01 delta u'; v' of the first color point divided by (2) the number of light emitters in the first plurality of light emitters that emit light having a color point that is within 0.01 delta u', v' of the second color point, A second ratio is equal to (1) the number of light emitters in the second plurality of light emitters 24 that emit light having a color point that is within 0.01 delta u', v' of the first color point divided by (2) the number of light emitters in the second plurality of light emitters that emit light having a color point that is within 0.01 delta u', v' of the second color point.

A third ratio is equal to (1) the number of light emitters in the third plurality of light emitters 25 that emit light having a color point that is within 0.01 delta u', v' of the first color point divided by (2) the number of light emitters in the third plurality of light emitters that emit light having a color point that is within 0.01 delta u', v' of the second color point.

The first ratio and the second ratio are both infinity, and the third ratio is zero, i.e., the first ratio and the second ratio are each greater than the third ratio.

The first sensor 21 is sensitive to BSY light (and is not sensitive to red or red-orange light), and the second sensor 22 is sensitive to red or red-orange light (and is not sensitive to BSY light).

The first power supply unit 15 controls the magnitude of the current supplied to the first string 18 (i.e., one of the two strings of BSY LEDs) and the second power supply unit 16 controls the magnitude of the current supplied to the second string 19 (the other of the two strings of BSY LEDs). The current supplied to the first string 18 and the current supplied to the second string 19 can be initially set to values (or a value) that is selected so that when light emitted by the LEDs on these strings is mixed with sufficient red/red-orange light to provide the desired color point for the mixed light output from the lighting device, the mixed light output from the lighting device will have the desired initial total lumen output.

As shown in FIG. 1, the BSY light sensor 21 and the red/red-orange light sensor 22 are used to control the third power supply unit 17 which controls the magnitude of the current supplied to the third string 20 (i.e., the red/red-orange light emitting diode string), so that the third power supply unit 17 maintains the ratio of red light (or red-orange light) to BSY light in order to maintain the desired color point (e.g., white light of a desired color temperature). Accordingly, the lighting device 10 comprises a controller that controls current supplied to the third plurality of light emitters based on a ratio of the brightness detected by the first sensor divided by the brightness detected by the second sensor.

The third power supply unit 17 may be configured to have a limit (i.e., a maximum drive current) on the magnitude of the current that it can supply to the third sting 20 (i.e., the string of red light emitting diodes), e.g., so that the power supply wattage rating is not exceeded. Thus, the lighting device 10 comprises a current limiter that limits current supplied to the third plurality of light emitters.

Figure 2:
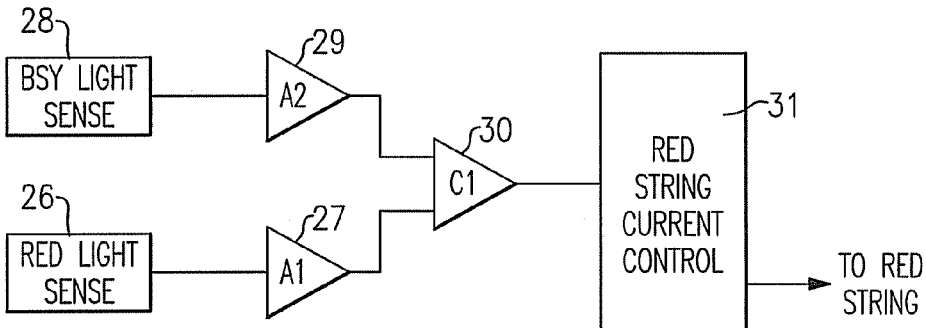
FIG. 2 is a block diagram of a circuit in accordance with the present inventive subject matter for controlling current supplied to light emitters.

FIG. 2 is a block diagram of a circuit for controlling current supplied to light emitters that emit light of a second hue (in this embodiment, red) based on a ratio of the brightness detected by a first sensor (which, in this embodiment, is sensitive to BSY light and no other light), divided by the brightness detected by the second sensor (which, in this embodiment, is sensitive to red light and no other light).

In FIG. 2, the output of a first sensor 26 which is selectively responsive to red light is provided to a first amplifier 27, and the output of a second sensor 28 that is selectively responsive to BSY light is provided to a second amplifier 29. The gain of the respective amplifiers 27 and 29 can be set to provide the desired ratio of BSY to red light. Additionally, the gain of the first and second amplifiers 27 and 29 can compensate for variations in sensitivity of the first and second sensors 26 and 28, respectively, i.e., the gain of the amplifiers can be present, set, chosen and/or adjusted to account for variations in the sensitivity of the sensors, e.g., to compensate for variations in different red sensors in different fixtures and/or variations in BSY sensors in different fixtures.

The respective outputs of the first and second amplifiers 27 and 29 (i.e., the scaled output of the BSY sensor 28 and the red sensor 26) are provided to a comparator 30. The output of the comparator 30 is used by a red string current controller 31 to control the drive current supplied to one or more light emitters that emit red light (i.e., the current supplied to at least one light emitter that emits red light, but not necessarily all light emitters in the lighting device that emit red light, and not necessarily only light emitters that emit red light) (e.g., in the embodiment illustrated in FIG. 1, to the third string 20 of light emitters 25 that emit red light). If the level of the output of the comparator 30 indicates that the scaled BSY level is higher than the scaled red level, then the current supplied to the one or more light emitters that emit red light is increased. If increasing the "red current" (i.e., current supplied to the one or more light emitters that emit red light) would cause the magnitude of the red current to exceed a preset maximum magnitude, then the red current will be set to that preset maximum magnitude. Optionally, a signal could be provided to a BSY string controller (and/or to one or more BSY string controllers) that indicates that the red current is at a maximum level and that causes the "BSY current" (i.e., the current supplied to one or more BSY light emitters (i.e., the current supplied to at least one light emitter that emits BSY light, but not necessarily all light emitters in the lighting device that emit BSY light, and not necessarily only light emitters that emit BSY light)) to be reduced. While such a system could be used to maintain the color point of the mixed output light from the lighting device, in some circumstances, it might bring about a reduction in the overall lumen level of the mixed output light from the lighting device. If the level of the output of comparator 30 indicates that the scaled BSY level is lower than the scaled red level, then the red current is decreased.

Figure 3:
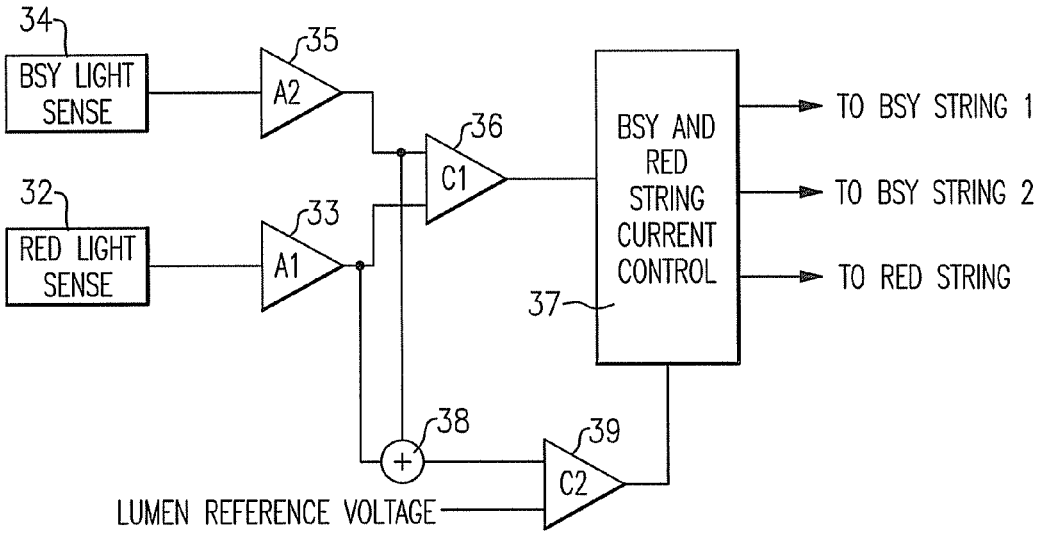
FIG. 3 is a block diagram of a circuit in accordance with the present inventive subject matter that includes circuitry that provides control of current supplied to one or more light emitters.

FIG. 3 is a block diagram of a circuit that includes circuitry that provides control of current supplied to one or more light emitters (in this embodiment, one or more light emitters that emit red light) based on the total brightness (in lumens) of the mixed light emitted by a lighting device.

In FIG. 3, the output of a first sensor 32 which is selectively responsive to red light is provided to a first amplifier 33, and the output of a second sensor 34 that is selectively responsive to BSY light is provided to a second amplifier 35.

The respective outputs of the first and second amplifiers 33 and 35 (i.e., the scaled output of the BSY sensor 34 and the red sensor 32) are provided to a comparator 36.

As illustrated in FIG. 3, the total brightness (in lumens) of the mixed light emitted by the lighting device may be approximated by summing the BSY and red scaled sense signals (see reference number 38). The total lumen value could be compared to a reference voltage established based on the sense signals when the lighting device is outputting a specified lumen level, by providing a second comparator 39. The lumen reference voltage may, for instance, reflect the initial lumen level of the device. In such a case, the device may be self tuning, in that the lumen level and color point may be established based on the integral sensors. Thus, the limit controller 39 limits current supplied to at least one light emitter based on the combined brightness of the mixed light emitted by the lighting device.

The comparison of the lumen reference voltage to the summed scaled BSY and red sense may be provided to a controller 37 and used to control the current supplied to one or more light emitters, e.g., in this embodiment, to strings that comprise one or more BSY light emitters and/or to strings that comprise one or more red light emitters. For example, if the summed value is less than the reference voltage, the BSY current may be increased and the red current may be adjusted to maintain the appropriate ratio. The BSY current may be increased until the sum of the scaled BSY light level and the scaled red sensed light level equals the lumen reference voltage. Similarly, if the summed sensed light levels is above the lumen reference voltage, the BSY current could be decreased and the red current could be adjusted to maintain the ratio of BSY light and red light. Thus, the embodiment depicted in FIG. 3 comprises a limit controller 39 that limits current supplied to at least one light emitter (e.g., to at least a second light emitter). In embodiments in which a dimmer is provided, during dimming, the lumen reference voltage could be disabled or adjusted as the device dims or it could be used to dim the lighting device. By decreasing the lumen reference voltage, the lumen output of the lighting device will be reduced and thus the lighting device could be directly dimmed by manipulation of the reference voltage.

Figure 4:
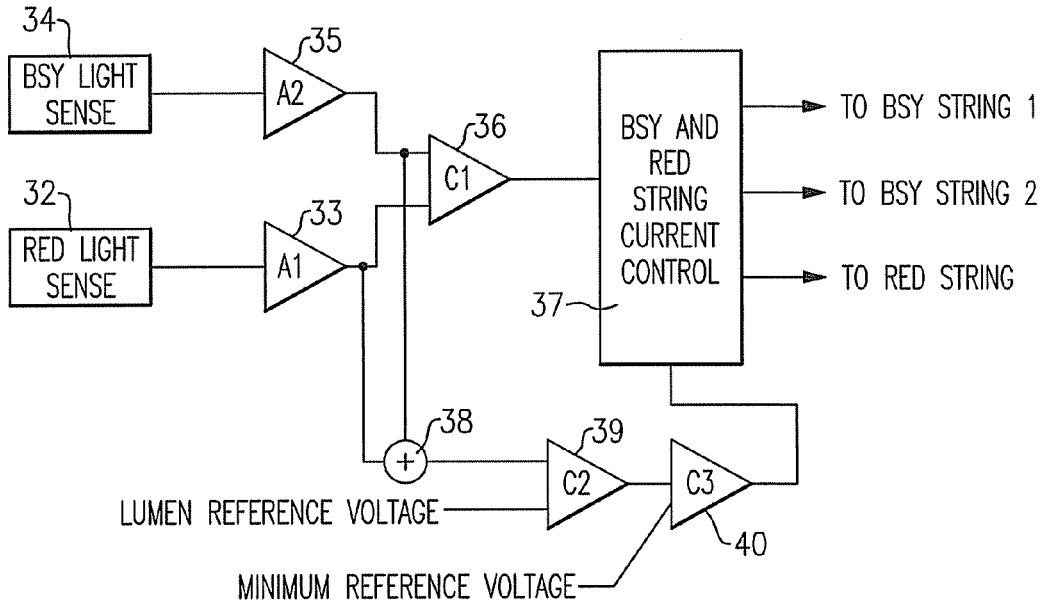
FIG. 4 is a block diagram of a circuit in accordance with the present inventive subject matter that includes circuitry that provides control of current supplied to one or more light emitters.

Additionally, a third comparator could be provided for end of life determination (e.g., to determine a cutoff point of use) for the lighting device. FIG. 4 is a block diagram that is similar to the block diagram illustrated in FIG. 3, except that the block diagram in FIG. 4 additionally depicts such a third comparator 40 determine a cutoff point of use for the lighting device. The third comparator 40 could compare the output of the comparator 39 to a minimum lumens reference voltage and disable the lighting device if the summed signal (from 38) falls below the minimum lumen reference voltage (e.g., if the deviation of the summed signal (from 38) relative to the lumen reference voltage exceeded a maximum lumen depreciation threshold, e.g., 30% (e.g., by setting the minimum lumen reference voltage at 70% of the lumen reference voltage).

Alternatively, returning to FIG. 3, the second comparator 39 could be used for end of life determination and the initial lumen output could be set by setting initial current levels for one or more of the light emitters (e.g., in some embodiments, for the BSY string(s)). The lumen reference voltage could then be set to correspond to an end of life lumen depreciation (e.g., 30%) and the device disabled when this level is reached.

Figure 5:
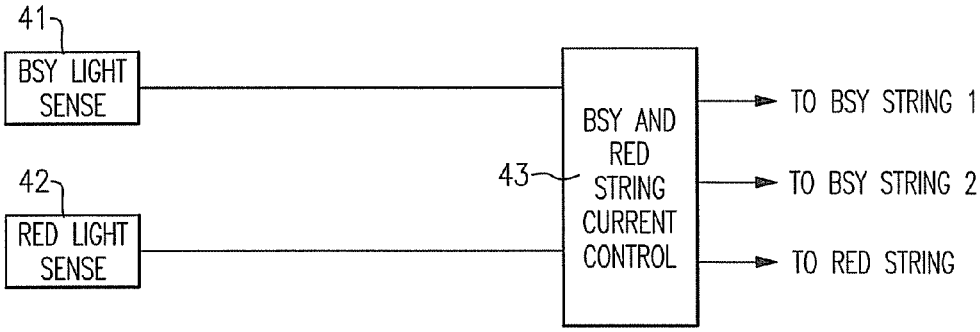
FIG. 5 is a block diagram of a circuit in accordance with the present inventive subject matter.

FIG. 5 is a block diagram of a circuit in which two sensed light levels (in this embodiment, BSY light level and red light level) are sensed by a first sensor 41 and a second sensor 42, respectively, and are provided directly to a controller 43 that controls the magnitudes of current supplied to the light emitters (e.g., the controller 43 could control the magnitude of current supplied to strings of BSY light emitters and the magnitude of current supplied to a string of red light emitters). The controller 43 could, for example, be a microcontroller or microprocessor. The operations illustrated in the flowcharts depicted in FIGS. 6 and 7 could be carried out by the controller 43 (e.g., microcontroller or microprocessor).

Figure 6:
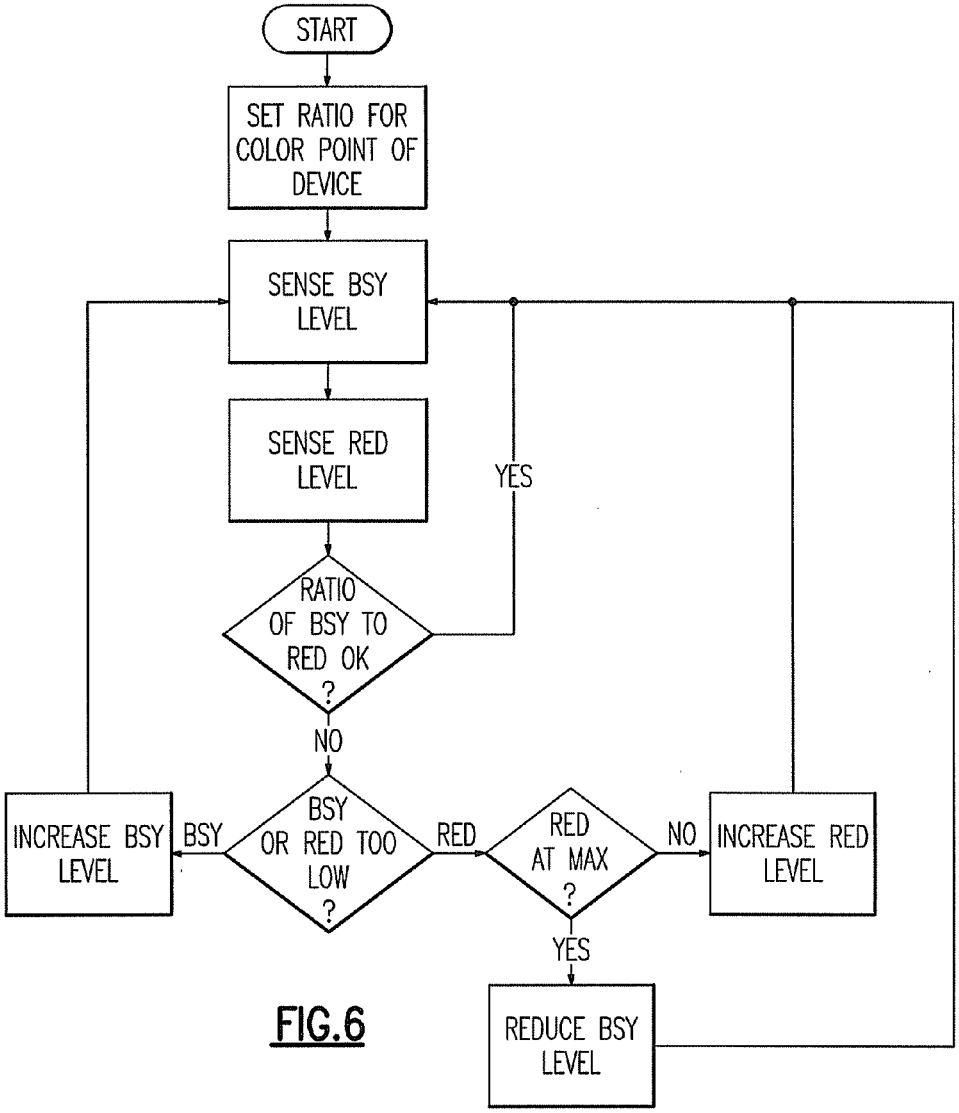
FIGS. 6 and 7 depict flowcharts the illustrate operations that can be carried out by a controller in accordance with the present inventive subject matter.
Figure 7:
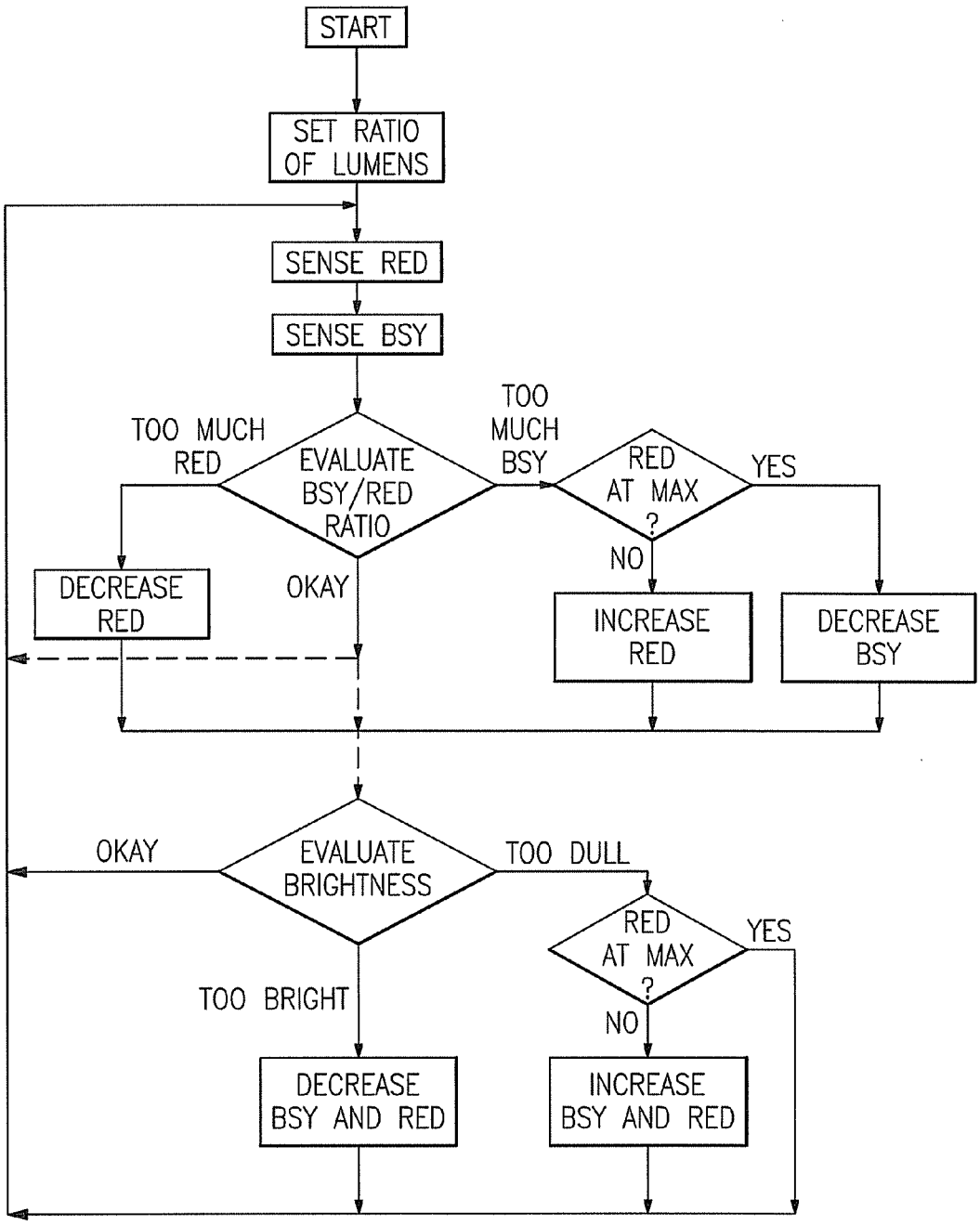

The operations illustrated in FIGS. 6 and 7 could also be implemented in analog circuitry. Accordingly, the present inventive subject matter is not limited to (and should not be considered to be limited to) digital implementations of these operations, but could apply to analog or combinations of analog and digital circuitry.

Figure 8:
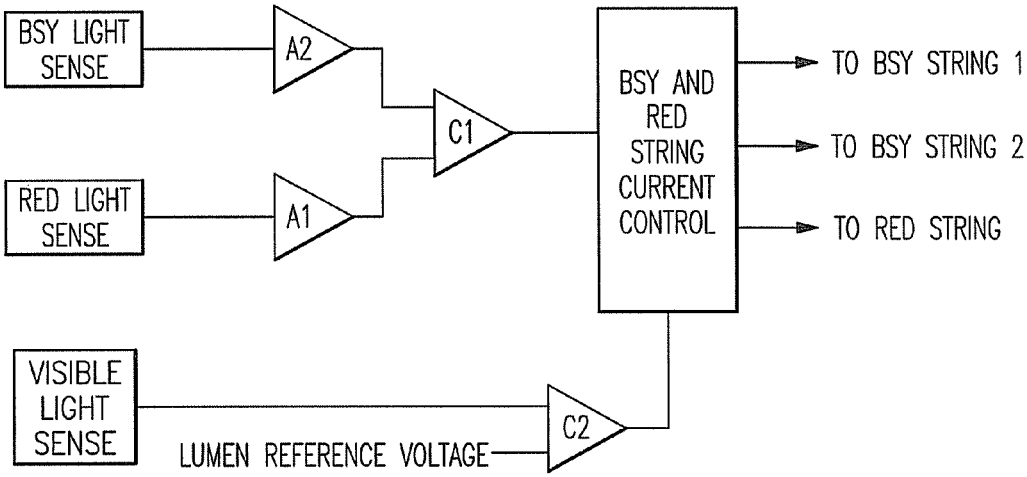
FIG. 8 is a block diagram of a circuit that includes circuitry that provides functionality that is similar to that provided by the circuit depicted in FIG. 3.

FIG. 8 is a block diagram of a circuit that includes circuitry that provides functionality that is similar to that provided by the circuit depicted in FIG. 3. The circuit depicted in FIG. 8 is similar to the circuit depicted in FIG. 3, except that instead of summing the BSY and red scaled sense signals (see reference number 38) in the circuit depicted in FIG. 3 to provide a total lumen value which can be compared to a reference voltage, there is provided a spectrum sensor 44 that detects a total brightness of all visible light hues (e.g., BSY and red). As with the embodiment depicted in FIG. 3, the embodiment depicted in FIG. 8 comprises a limit controller 39. In the embodiment depicted in FIG. 8, the limit controller 39 limits current supplied to at least one light emitter based on the brightness detected by the spectrum sensor 44.

Figure 9:
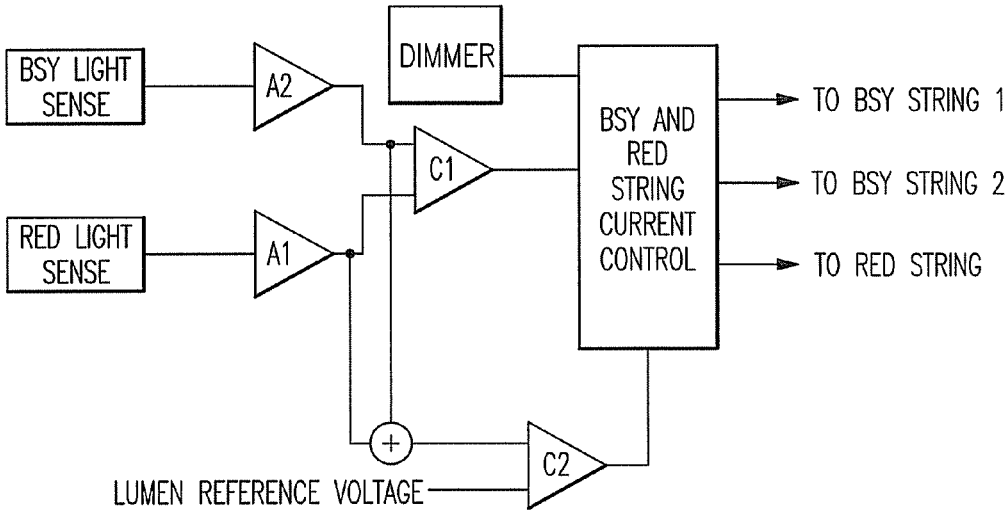
FIG. 9 is a block diagram of a circuit in accordance with the present inventive subject matter.

FIG. 9 is a block diagram of a circuit that is similar to the circuit depicted in FIG. 3, except that the circuit depicted in FIG. 9 further comprises a dimmer 45 that can be activated to bring about a sealed reduction in the magnitude of the current supplied to each of the light emitters, or to bring about a reduction in fewer than all of the light emitters while maintaining the desired mixed output color point. In some embodiments, the lighting device can be configured so that the color point of the combined output of light emitted from the lighting device changes based on the degree of dimming created by the dimmer (e.g., by the dimmer being manipulated by a user and/or being automatically actuated as a result of some other activity (e.g., a detected parameter or a preset time sequence).

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.). Similarly, any two or more functions can be conducted simultaneously, and/or any function can be conducted in a series of steps.

The invention claimed is:

1. A lighting device, comprising:

at least a first group of light emitters and a second group of light emitters, a first string and a second string, the first string comprising a first plurality of light emitters, so that when current is supplied to the first string, energy is supplied to the first plurality of light emitters, the second string comprising a second plurality of light emitters, so that when current is supplied to the second string, energy is supplied to the second plurality of light emitters, the first plurality of light emitters comprising at least a first light emitter that emits light having a first color point, and at least a second light emitter that emits light having a second color point, the second color point different from the first color point, the second plurality of light emitters comprising at least a third light emitter that emits light having a third color point and a fourth light emitter that emits light having a fourth color point, the third color point within 0.01 delta u', v' coordinates of the first color point, the fourth color point within 0.01 delta u', v' coordinates of the second color point;

at least a first sensor that detects brightness of at least light that is within 0.01 delta u', v' coordinates of the first color point; and at least a second sensor that detects brightness of at least light that is within 0.01 delta u', v' coordinates of the second color point, a first ratio, which is equal to (1) the number of light emitters in the first plurality of light emitters that emit light having a color point that is within 0.01 delta u', v' of the first color point divided by (2) the number of light emitters in the first plurality of light emitters that emit light having a color point that is within 0.01 delta u', v' of the second color point, is greater than a second ratio, which is equal to (1) the number of light emitters in the second plurality of light emitters that emit light having a color point that is within 0.01 delta u', v' of the first color point divided by (2) the number of light emitters in the second plurality of light emitters that emit light having a color point that is within 0.01 delta u', v' of the second color point.

2. A lighting device as recited in claim 1, wherein the lighting device further comprises at least a first controller that controls current supplied to at least the second light emitter based on (1) a ratio of the brightness detected by the first sensor divided by the brightness detected by the second sensor, and/or (2) a ratio of the brightness detected by the second sensor divided by the brightness detected by the first sensor.

3. A lighting device as recited in claim 1, wherein the lighting device further comprises at least a first spectrum sensor that detects a total brightness of all visible light hues.

4. A lighting device as recited in claim 1, wherein:

the first color point is within:

(1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53 (in the 1976 CIE Chromaticity Diagram, the first point has u', v' coordinates of 0.17, 0.48, the second point has u', v' coordinates of 0.20, 0.48, the third point has u', v' coordinates of 0.22, 0.53, the fourth point has u', v' coordinates of 0.22, 0.55, and the fifth point has u', v' coordinates of 0.18, 0.55); and the second color point is saturated light having a dominant wavelength in the range of from about 600 nm to about 700 nm.

5. A lighting device as recited in claim 1, wherein when electricity is supplied to the lighting device, a mixture of light exiting the lighting device is white light.

6. A lighting device as recited in claim 1, wherein a mixture of (1) light emitted by the at least a first light emitter that emits light having a first color point and (2) light emitted by the at least a second light emitter that emits light having a second color point is white light.

7. A lighting device as recited in claim 1, wherein the lighting device further comprises at least a first spectrum sensor that detects a total brightness of all visible light hues.

8. A lighting device as recited in claim 7, wherein the lighting device further comprises at least a first limit controller that limits current supplied to at least one of the first and second light emitters based on the brightness detected by the first spectrum sensor.

9. A lighting device as recited in claim 8, wherein:

the lighting device further comprises a dimmer;

the dimmer can be adjusted to select a maximum brightness;

the limit controller reduces the current supplied to at least one of the first and second light emitters if the brightness detected by the first spectrum sensor exceeds the maximum brightness.

10. A lighting device as recited in claim 1, wherein the lighting device further comprises at least a first dimmer.

11. A lighting device as recited in claim 1, wherein the first light emitter comprises at least a first solid state light emitter.

12. A lighting device as recited in claim 11, wherein the first solid state light emitter comprises at least a first light emitting diode.

13. A lighting device as recited in claim 12, wherein the first solid state light emitter further comprises at least a first luminescent material.

14. A lighting device as recited in claim 11, wherein the first solid state light emitter comprises at least a first luminescent material.

15. A method, comprising:

supplying energy to at least a first light emitter that emits light having a first color point;

supplying energy to at least a second light emitter that emits light having a second color point, the second color point different from the first color point;

detecting brightness of at least light that is within 0.01 delta u', v' coordinates of the first color point;

detecting brightness of at least light that is within 0.01 delta u', v' coordinates of the second color point; and controlling current supplied to at least the second light emitter based on (1) a ratio of (a) the brightness of at least light that is within 0.01 delta u', v' of the first color point detected by a first sensor to (b) the brightness of at least light that is within 0.01 delta u', v' of the second color point detected by a second sensor, and/or (2) a ratio of (b) the brightness of at least light that is within 0.01 delta u', v' of the second color point detected by a second sensor to (a) the brightness of at least light that is within 0.01 delta u', v' of the first color point detected by a first sensor.

16. A method as recited in claim 15, wherein the method further comprises limiting current supplied to at least the second light emitter.

17. A method as recited in claim 15, wherein the method further comprises detecting a total brightness of all visible light hues.

18. A method as recited in claim 17, wherein the method further comprises limiting current supplied to at least one of the first and second light emitters based on the brightness of all visible light hues detected by a first spectrum sensor.

19. A method as recited in claim 15, wherein:

the first color point is within (1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53 (in the 1976 CIE Chromaticity Diagram, the first point has u', v' coordinates of 0.17, 0.48, the second point has u', v' coordinates of 0.20, 0.48, the third point has u', v' coordinates of 0.22, 0.53, the fourth point has u', v' coordinates of 0.22, 0.55, and the fifth point has u', v' coordinates of 0.18, 0.55); and the second color point is saturated light having a dominant wavelength in the range of from about 600 nm to about 700 nm.

20. A method as recited in claim 15, wherein a mixture of light exiting the lighting device is white light.

21. A method as recited in claim 15, wherein a mixture of (1) light emitted by the at least a first light emitter that emits light having a first color point and (2) light emitted by the at least a second light emitter that emits light having a second color point is white light.

22. A method as recited in claim 15, wherein the method further comprises detecting a total brightness of all visible light hues.

23. A method as recited in claim 22, wherein the method further comprises limiting current supplied to at least one of the first and second light emitters based on the total brightness of all visible light hues detected by a first spectrum sensor.

24. A method as recited in claim 23, wherein:

the method further comprises reducing the current supplied to at least one of the first and second light emitters if the brightness detected by the first spectrum sensor exceeds a maximum brightness set on a dimmer.

25. A method as recited in claim 15, wherein the method further comprises reducing the current supplied to at least one of the first and second light emitters if the brightness detected by the first spectrum sensor exceeds a maximum brightness set on a dimmer.

26. A lighting device, comprising:

at least a first light emitter that emits light having a first color point;

at least a second light emitter that emits light having a second color point, the second color point different from the first color point;

at least a first sensor that detects brightness of at least light that is within 0.01 delta u', v' of the first color point;

at least a second sensor that detects brightness of at least light that is within 0.01 delta u', v' of the second color point; and at least a first controller that controls current supplied to at least the second light emitter based on (1) a ratio of the brightness detected by the first sensor divided by the brightness detected by the second sensor, and/or (2) a ratio of the brightness detected by the second sensor divided by the brightness detected by the first sensor.

27. A lighting device as recited in claim 26, wherein the lighting device further comprises at least a first current limiter that limits current supplied to at least the second light emitter.

28. A lighting device as recited in claim 26, wherein the lighting device further comprises at least a first spectrum sensor that detects a total brightness of all visible light hues.

29. A lighting device as recited in claim 28, wherein the lighting device further comprises at least a first limit controller that limits current supplied to at least one of the first and second light emitters based on the brightness detected by the first spectrum sensor.

30. A lighting device as recited in claim 26, wherein the lighting device further comprises at least a first spectrum sensor that detects a total brightness of all visible light hues.

31. A lighting device as recited in claim 30, wherein the lighting device further comprises at least a first limit controller that limits current supplied to at least one of the first and second light emitters based on the brightness detected by the first spectrum sensor.

32. A lighting device as recited in claim 31, wherein:

the lighting device further comprises a dimmer;

the dimmer can be adjusted to select a maximum brightness;

the first limit controller reduces the current supplied to at least one of the first and second light emitters if the brightness detected by the first spectrum sensor exceeds the maximum brightness.

33. A lighting device, comprising:

at least a first light emitter that emits light having a first color point;

at least a second light emitter that emits light having a second color point, the second color point different from the first color point;

at least a first sensor that detects brightness of at least light that is within 0.01 delta u', v' of the first color point; and at least a second sensor that detects brightness of at least light that is within 0.01 delta u', v' of the second color point, the first color point within:

(1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53 (in the 1976 CIE Chromaticity Diagram, the first point has u', v' coordinates of 0.17, 0.48, the second point has u', v' coordinates of 0.20, 0.48, the third point has u', v' coordinates of 0.22, 0.53, the fourth point has u', v' coordinates of 0.22, 0.55, and the fifth point has u', v' coordinates of 0.18, 0.55); and the second color point is saturated light having a dominant wavelength in the range of from about 600 nm to about 700 nm.

34. A method, comprising:

supplying energy to at least a first light emitter that emits light having a first color point;

supplying energy to at least a second light emitter that emits light having a second color point, the second color point different from the first color point;

detecting brightness of at least light that is within 0.01 delta u', v' of the first color point; and detecting brightness of at least light that is within 0.01 delta u', v' of the second color point, the first color point within (1) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.32, 0.40, the second point having x, y coordinates of 0.36, 0.48, the third point having x, y coordinates of 0.43, 0.45, the fourth point having x, y coordinates of 0.42, 0.42, and the fifth point having x, y coordinates of 0.36, 0.38, and/or (2) an area on a 1931 CIE Chromaticity Diagram enclosed by first, second, third, fourth and fifth line segments, the first line segment connecting a first point to a second point, the second line segment connecting the second point to a third point, the third line segment connecting the third point to a fourth point, the fourth line segment connecting the fourth point to a fifth point, and the fifth line segment connecting the fifth point to the first point, the first point having x, y coordinates of 0.29, 0.36, the second point having x, y coordinates of 0.32, 0.35, the third point having x, y coordinates of 0.41, 0.43, the fourth point having x, y coordinates of 0.44, 0.49, and the fifth point having x, y coordinates of 0.38, 0.53 (in the 1976 CIE Chromaticity Diagram, the first point has u', v' coordinates of 0.17, 0.48, the second point has u', v' coordinates of 0.20, 0.48, the third point has u', v' coordinates of 0.22, 0.53, the fourth point has u', v' coordinates of 0.22, 0.55, and the fifth point has u', v' coordinates of 0.18, 0.55); and the second color point is saturated light having a dominant wavelength in the range of from about 600 nm to about 700 nm.

* * * * *

UNITED STATES PATENT AND TRADEMARK OFFICE

CERTIFICATE OF CORRECTION

PATENT NO. : 8,847,513 B2
APPLICATION NO. : 13/042668
DATED : September 30, 2014
INVENTOR(S) : Antony Paul Van De Ven and Gerald H. Negley It is certified that error appears in the above-identified patent and that said Letters Patent is hereby corrected as shown below:

ON THE TITLE PAGE

Item (57) Abstract

Please change line 6: “second light,” to -- second light --

IN THE CLAIMS

Column 37, line 42

(claim 1): Please change “first color point,” to -- first color point --

Column 38, lines 14-15

(claim 3): Please change “spectrum sensor that detects a total brightness of all visible light hues.” to -- current limiter that limits current supplied to at least the second light emitter. --

Signed and Sealed this
Twenty-fourth Day of February, 2015

Michelle K. Lee

Michelle K. Lee
*Deputy Director of the United States Patent and Trademark Office*